US007934347B2

(12) United States Patent
Brienen

(10) Patent No.: US 7,934,347 B2
(45) Date of Patent: May 3, 2011

(54) COUPLING BEAM AND METHOD OF USE IN BUILDING CONSTRUCTION

(76) Inventor: Paul Brienen, Kent, WA (US)

( * ) Notice: Subject to any disclaimer, the term of this patent is extended or adjusted under 35 U.S.C. 154(b) by 323 days.

(21) Appl. No.: 11/881,517

(22) Filed: Jul. 27, 2007

(65) Prior Publication Data

US 2008/0022623 A1 Jan. 31, 2008

Related U.S. Application Data

(60) Provisional application No. 60/834,289, filed on Jul. 28, 2006.

(51) Int. Cl.
*E04H 12/00* (2006.01)

(52) U.S. Cl. ..... 52/650.1; 52/583.1; 52/587.1; 52/414; 52/259

(58) Field of Classification Search ..... 52/650.1, 52/583.1, 587.1, 650.2, 414, 660, 657, 250, 52/251, 259, 260, 648.1, 649.1, 649.2, 649.3, 52/236.8

See application file for complete search history.

(56) References Cited

U.S. PATENT DOCUMENTS

| | | | | |
|---|---|---|---|---|
| 574,434 | A * | 1/1897 | Keithley | 52/236.3 |
| 810,221 | A * | 1/1906 | Pierson | 52/854 |
| 820,921 | A * | 5/1906 | Cheney | 52/98 |
| 960,305 | A * | 6/1910 | Gilbreth | 52/223.11 |
| 995,069 | A * | 6/1911 | Lewen | 52/431 |
| 1,046,117 | A | 12/1912 | Skinner | |
| 1,094,517 | A | 4/1914 | Blessing | |

(Continued)

FOREIGN PATENT DOCUMENTS

| | | |
|---|---|---|
| CA | 771849 | 11/1967 |
| EP | 1607547 A1 | 12/2005 |
| SU | 619608 A1 | 8/1978 |

OTHER PUBLICATIONS

Slak, T., Kilar, V., Initial Conceptual Design of Earthquake Resistant R/C and Masonry Buildings According to Eurocode 8., University of Ljubljana, Faculty of Architecture, Slovenia. (undated) (12 pages).

(Continued)

*Primary Examiner* — Brian E Glessner
*Assistant Examiner* — James Ference
(74) *Attorney, Agent, or Firm* — R. Reams Goodloe, Jr.

(57) ABSTRACT

A coupling beam, and method for constructing multi-story buildings. A coupling beam design using multiple rebar groups is provided for use in coupled shear walls in multi-story buildings. First and second sets of a first rebar group have first ends extending into adjacent sheer walls, and second ends within the coupling beam. First and second sets of a second rebar group have first ends extending into adjacent sheer walls, and second ends within the coupling beam. The first and second sets of the first group of rebar, and third and fourth sets within a second group of rebar, are provided in a configuration that ends at or near the middle of the coupling beam, providing an open or partial-X configuration of reinforcing steel. Such coupling beams may also include transverse reinforcement, such as stirrups, hoops, or cross-ties, to restrain the concrete and to provide a confined beam structure, as well as vertical reinforcement elements. A method is provided for constructing multi-story buildings having a core and adjacent space, using such coupling beams. In such buildings, increased floor space is provided at reduced cost, yet the earthquake resistance is as good as or better than conventionally constructed designs.

45 Claims, 30 Drawing Sheets
(8 of 30 Drawing Sheet(s) Filed in Color)

U.S. PATENT DOCUMENTS

| | | | | | |
|---|---|---|---|---|---|
| 1,233,053 | A | | 7/1917 | Hartman | |
| 1,629,134 | A | * | 5/1927 | Van Hoffen | 52/666 |
| 1,883,376 | A | | 10/1932 | Hilpert et al. | |
| 2,408,585 | A | * | 10/1946 | Smith | 264/31 |
| 2,413,990 | A | | 1/1947 | Muntz | |
| 2,616,148 | A | | 11/1952 | Hawes | |
| 2,754,674 | A | | 7/1956 | Malsbury et al. | |
| 2,940,295 | A | * | 6/1960 | Post | 52/204.1 |
| 2,966,242 | A | * | 12/1960 | Kaiser | 52/376 |
| 3,084,481 | A | | 4/1963 | Silberkuhl et al. | |
| 3,108,406 | A | * | 10/1963 | Ellis | 52/577 |
| 3,121,894 | A | * | 2/1964 | Cheng | 14/13 |
| 3,302,348 | A | | 2/1967 | Pratt | |
| 3,435,572 | A | * | 4/1969 | Fuchs | 52/251 |
| 3,555,753 | A | * | 1/1971 | Magadini | 52/223.7 |
| 3,712,008 | A | | 1/1973 | Georgiev et al. | |
| 3,783,565 | A | | 1/1974 | Hughes | |
| 3,867,805 | A | | 2/1975 | Mikami et al. | |
| 3,916,592 | A | | 11/1975 | Morohashi et al. | |
| 3,952,472 | A | | 4/1976 | Boehmig | |
| 4,040,220 | A | | 8/1977 | Henager | |
| 4,091,594 | A | | 5/1978 | Yamashita | |
| 4,094,111 | A | | 6/1978 | Creegan | |
| 4,147,009 | A | | 4/1979 | Watry | |
| 4,409,764 | A | | 10/1983 | Wilnau | |
| 4,443,985 | A | | 4/1984 | Moreno | |
| 4,903,448 | A | | 2/1990 | Compton | |
| 4,993,095 | A | | 2/1991 | Lautensleger et al. | |
| 5,119,614 | A | | 6/1992 | Rex | |
| 5,375,382 | A | | 12/1994 | Weidlinger | |
| 5,381,633 | A | | 1/1995 | Hendrich | |
| 5,660,017 | A | | 8/1997 | Houghton | |
| 5,809,712 | A | | 9/1998 | Simanjuntak | |
| 5,809,722 | A | * | 9/1998 | Bertsche | 52/334 |
| 5,813,181 | A | | 9/1998 | Ashton et al. | |
| 6,112,486 | A | | 9/2000 | Ashton et al. | |
| 6,151,858 | A | | 11/2000 | Ruiz et al. | |
| 6,293,063 | B2 | | 9/2001 | Van Doren | |
| 6,385,930 | B1 | | 5/2002 | Broms et al. | |
| 6,389,767 | B1 | | 5/2002 | Lucey et al. | |
| 6,397,528 | B1 | | 6/2002 | Rahaimian | |
| 6,425,220 | B1 | | 7/2002 | Ashton et al. | |
| 6,543,195 | B2 | | 4/2003 | Rahimzadeh | |
| 6,629,394 | B1 | * | 10/2003 | Trevino | 52/677 |
| 6,826,882 | B2 | | 12/2004 | Lucey et al. | |
| 6,851,232 | B1 | | 2/2005 | Schwegler | |
| 6,892,504 | B1 | * | 5/2005 | diGirolamo et al. | 52/657 |
| 6,920,728 | B2 | | 7/2005 | Powers | |
| 7,461,488 | B2 | * | 12/2008 | Black | 52/295 |
| 2002/0011037 | A1 | | 1/2002 | Capra | |
| 2002/0040560 | A1 | * | 4/2002 | Kent et al. | 52/633 |
| 2003/0115825 | A1 | * | 6/2003 | Crump, Jr. | 52/704 |
| 2004/0003548 | A1 | | 1/2004 | Sahai | |
| 2004/0083663 | A1 | | 5/2004 | Englekirk et al. | |
| 2004/0231278 | A1 | | 11/2004 | Yin et al. | |
| 2005/0235597 | A1 | | 10/2005 | Li et al. | |
| 2005/0257451 | A1 | | 11/2005 | Pryor et al. | |

OTHER PUBLICATIONS

Su, R.K.L.; Pam, H.J.; Lam, W.Y., Plate Reinforced Composite (PRC) Coupling Beam. http://web.hku.hk/~k1su/Research%20Projects/plate.htm (undated) (2 pages).

Kuang, J.S., Baczkowski, B.J., Sear Capacity of Reinforced Steel-Fiber-Concrete Coupling Beams (Abstract only) (undated). (1 page).

Parra-Montesinos, G.; High-Performance Fiber Reinforced Cement Composites: An Alternative for Seismic Design of Structures, ACI Structural Journal, Title No. 102-S68, Sep.-Oct. 2005 (8 pages).

Canbolat, B., Parra-Montesinos, G., and Wight, J.K., Experimental Study on Seismic Behavior of High Performance Fiber-Reinforced Cement Composite Coupling Beams, ACI Structural Journal, Title No. 102-S17, Jan.-Feb. 2005 (8 pages).

Galano, L.; Vignoli, A., Seismic Behavior of Short Coupling Beams with Different Reinforcement Layouts. ACI Structural Journal, Title No. 97-S89, Nov.-Dec. 2000 (10 pages).

Erico Catalogue Cutsheet, ER-3967 (undated) (1 page) see: http://www.erico.com.

INPADOC Record, Delphion, SU0619608T: Joint of Elements of Earthquake-Proof Framework of Building, Published Aug. 15, 1978. (1 page).

Dauriac, Christophe, Special Concrete May Give Steel Stiff Competition, HDR Engineering, Seattle Daily Journal of Commerce, May 9, 1997 (5 pages) Webpage: http//www.djc.com/special/concrete97/10024304.htm.

Harries, K.A.; Mitchell, D.; Redwood, R.G.; Cook, W.D., Seismic Design of Coupled Walls—A Case for Mixed Construction (Can. J. Civ. Eng. 24: 448-459 (1997).

Technical Notes on Brick Construction, Technical Notes 17B—Reinforced Brick Masonry—Beams, Brick Industry Association, Mar. 1999 (14 pages) Webpage: http//www.bia.org/BIA/technotes/t17b.htm.

Lam, W.Y.; Su, R.K.L; Pam, H.J., Strength and Ductility of Embedded Steel Composite Coupling Beams. Advances in Structural Engineering, vol. 6., No. 1, (2003).

Legacy Report on the 1997 Uniform Building Code™, ICC Evaluation Service, Inc., ES Legacy Report, ER, 5292, Jan. 1, 2004 (2 pages).

Harries, K., Moulton, J.D., Clemson, R.L., Parametric Study of Coupled Wall Behavior—Implications for the Design of Coupling Beams, Journal of Structural Engineering © ASCE, Mar. 2004 (pp. 480-488).

Lynch, J.P.; Parra-Montesinos, G.; Canbolat, B.A.; Hou, T.C., Real-Time Damage Prognosis of High Performance Fiber Reinforced Cementitious Composite Structures. Proceedings of Advances in Structural Engineering and Mechanics (ASEM), Sep. 2, 2004.

Harries, K.A., Discussion of "Seismic Force Modification Factors for the Proposed 2005 Edition of the National Building Code of Canada"; Discussion, Canadian Journal Civil Engineering 31: (2004) (pp. 393-394).

Fortney, Patrick, J., The Next Generation of Coupling Beams, A Dissertation submitted to the Division of Research and Advanced Studies of the University of Cincinnati, Department of Civil and Environmental Engineering of the College of Engineering, May 3, 2005, (370 pages).

Erico International Corporation, Product Catalogue, webpage dated Mar. 3, 2006 (5 pages) Webpage: htttp://www.erico.com/products.asp?folderid=173.

Struct, J., Experimental Study on Embedded Steel Plate Composite Coupling Beams, vol. 131, Issue 8, Journal of Structural Engineering. vol. 131, Issue 8, pp. 1294-1302 (Aug. 2005) (Abstract only) (1 page).

* cited by examiner 54
52
56
58
R
B11B
B11A
F=11
B10B
B10A
F=10
B9B
B9A
F=9
B8B
B8A
F=8
B7B
B7A
F=7
B6B
B6A
F=6
B5B
B5A
F=5
B4B
B4A
F=4
B3B
B3A
F=3
B2B
B2A
F=2
56
54
52
F=1
50

P2
P1
R2C
120
131
132
133
134
126
R2D
B2A
R1A
122
141
142
143
144
124
64
66
62
LB
R1B
54
52

Specimen DBCB-1

COUPLING BEAM

PRIOR ART

NOTES :

(B) DIAGS START AT BOTTOM END OF BEAM AND TERMINATE AT TOP MID-SPAN OF BEAM (A) DIAGS START AT TOP END OF BEAM AND TERMINATE AT BOTTOM MID-SPAN OF BEAM

Current Practice – 1% Rotation

Partial X – 1% Rotation

Current Practice – 2% Rotation

Partial X – 2% Rotation

Current Practice – 3% Rotation

Partial X – 3% Rotation

Current Practice – 4% Rotation

Partial X – 4% Rotation

Current Practice – 5% Rotation

Partial X – 5% Rotation

Current Practice – 6% Rotation

Partial X – 6% Rotation

Partial X – 7% Rotation

Partial X – 8% Rotation

Partial X – 9% Rotation

COUPLING BEAM AND METHOD OF USE IN BUILDING CONSTRUCTION

RELATED PATENT APPLICATIONS

This invention claims priority from U.S. Provisional Patent Application Ser. No. 60/834,289 filed on Jul. 28, 2006, entitled "COUPLING BEAM AND METHOD OF USE IN BUILDING CONSTRUCTION", the disclosure of which is incorporated herein in its entirety (including the specification, drawing, claims, and appendix) by this reference.

COPYRIGHT NOTICE

A portion of the disclosure of this patent document contains material that is subject to copyright protection. The patent owner has no objection to the facsimile reproduction by anyone of the patent document or the patent disclosure, as it appears in the Patent and Trademark Office patent file or records, but otherwise reserves all copyright rights whatsoever.

COLOR PHOTOGRAPHS AS DRAWINGS

The patent or application file contains at least one drawing executed in color. Copies of this patent or patent application publication with color drawings will be provided by the U.S. Patent and Trademark Office upon request and payment of the necessary fee.

TECHNICAL FIELD

This invention relates to the field of building construction, and especially to the field of construction of buildings utilizing coupled shear wall systems that utilize lateral force resistant coupling beams.

BACKGROUND

In the construction of buildings in earthquake prone regions, structures must be designed to withstand lateral forces and displacements due to seismic events. One design approach that has been increasingly utilized in multi-story buildings is to provide a coupled shear wall system. Various types of construction materials have been utilized in coupled shear wall systems. When such buildings include portions that are constructed from reinforced concrete, lengths of steel reinforcing "rebar" are normally used internal within concrete components. In such systems, the need arises for the use of a reinforced concrete coupling beam to span an otherwise open space between building components such as adjacent sheer walls. As an example, coupling beams are often utilized in the core structures of multi-story buildings to span between shear wall piers at the elevator or stair shafts. When coupling beams are employed, in many locales, various building codes dictate either the design requirements of such a component, or less commonly, the performance requirements of such a component, or in some instances, both. As a result, relatively complex and expensive designs have become the norm for multi-story building construction. The existing designs with which I am familiar are often relatively expensive to construct due to the labor intensive process of placing long inclined reinforcing bars through congested shear wall segments and coupling beams. Both the number of manhours required for construction personnel to install many components, as well as the relatively large quantity of reinforcing steel components, contribute to the cost. As a typical example, various building codes currently require the use of two intersecting groups of symmetrical diagonally placed reinforcing groups extending across the full length of the coupling beam, with the rebars adequately anchored within the adjacent sheer walls. While such prior art coupling beams, as well as other coupling beam designs, are currently available, and such designs vary in their effectiveness in resisting seismic events, especially as applied in the construction of multi-story buildings utilizing coupled shear wall systems.

By way of background, during a seismic event, the coupling beams of a coupled shear wall system are assumed to remain ductile and continue to dissipate energy well into the anticipated non-linear seismic building displacements as predicted by the various building codes, usually defined as either an earthquake having a 2% chance of excedence within a fifty (50) year period, or a an earthquake having a 10% chance of exceedence within a fifty (50) year period. Thus, in most multi-story buildings, especially mid-rise to high-rise buildings, the associated rotational demand or shear angle on the coupling beams in the coupled shear wall system will typically range in excess of about 5%, and sometimes may range from about 5% to about 6%. Thus, coupling beam designs should be able to withstand such demands while exhibiting stable hysteretic properties.

Since many buildings utilize coupled core wall systems, it would be desirable to achieve substantially equivalent or even better seismic performance results in coupling beams in coupled shear wall systems at reduced installed cost. Such cost reduction may be achieved by reducing the costs for labor and/or for components in such coupling beams, by reducing the shear wall thickness that is typically controlled by constructability requirements of the coupling beams, and by reducing the schedule length required for completion of construction of such components. Further, it would be advantageous, especially considering the relatively high value of a square foot of leasable or saleable floor space in many multi-story buildings, to reduce the "parasitic load" of unleasable or unsaleable floor space, by decreasing the floor space consumed by necessary shear walls in a particular building design.

Consequently, there remains a significant and as yet unmet need for a simple to construct, low material cost, and seismically effective coupling beam design adapted for use with multi-story buildings, such as high-rise offices, hospitals, or condominiums.

BRIEF DESCRIPTION OF DRAWING

The patent or application file contains at least one drawing executed in color. Copies of this patent or patent application publication with color drawing(s) will be provided by the Office upon request and payment of the necessary fee.

The present invention will be described by way of exemplary embodiments, illustrated in the accompanying drawing in which like references denote similar elements, and in which:

FIGS. 11, 12, and 13 show details of various designs that may be utilized at first and/or second ends of the reinforcing steel lengths utilized in a concrete coupling beam, especially for the diagonal reinforcing steel components.

FIG. 11 illustrates the use of a length of reinforcing steel without use of a mechanical anchor or other device; however, most reinforcing steel includes patterned surface ribbing that increases bond with the adjacent concrete in the coupling beam.

FIG. 12 illustrates the use of a standard hook on a length of reinforcing steel; such an end increases the resistance to pull-out through the concrete.

FIG. 19(A) shows a side elevation view of the coupled shear wall system design tested, and with respect to which results are photographically illustrated in FIGS. 23, 25, 27, 29, 31, 33, 34, 35, and 36.

FIG. 19(B) provides further detail of the coupling beam portion of the coupled shear wall system first identified within the broken lines shown as FIG. 19(B) within FIG. 19(A).

FIG. 19(C) provides a horizontal sectional view, taken along line C-C of FIG. 19(B), now showing a portion of the reinforcing steel used in one adjacent shear wall pier and the transverse reinforcing steel used to confine the shear wall concrete.

FIG. 19(D) shows a cross-sectional view of an exemplary coupling beam, taken along line D-D of FIG. 19(A), showing a first group of first and second sets of inclined reinforcing steel utilized in the coupling beam, as well as transverse reinforcing components utilized for confinement and shear reinforcement of the coupling beam.

FIG. 19(E) is a partial side elevation view that shows the vertical and horizontal rebar configuration utilized in a first wall section in a coupled wall system, as first shown in FIG. 19(A), as constructed for performance testing.

FIG. 22 is a photographic view showing cracking in the coupling beam of a prior art coupled shear wall system during performance testing, at 1% rotation.

FIG. 23 is a photographic view showing cracking in a novel partial-X coupling beam design in a coupled shear wall system, shown during performance testing at 1% rotation.

FIG. 24 is a photographic view showing cracking in the coupling beam of a prior art coupled shear wall system during performance testing, at 2% rotation.

FIG. 25 is a photographic view showing cracking in a novel partial-X coupling beam design in a coupled shear wall system, shown during performance testing at 2% rotation.

FIG. 26 is a photographic view showing cracking in the coupling beam of a prior art coupled shear wall system during performance testing, at 3% rotation.

FIG. 27 is a photographic view showing cracking in a novel partial-X coupling beam design in a coupled shear wall system, shown during performance testing at 3% rotation.

FIG. 28 is a photographic view showing cracking in the coupling beam of a prior art coupled shear wall system during performance testing, at 4% rotation.

FIG. 29 is a photographic view showing cracking in a novel partial-X coupling beam design in a coupled shear wall system, shown during performance testing at 4% rotation.

FIG. 30 is a photographic view showing cracking in the coupling beam of a prior art coupled shear wall system during performance testing, at 5% rotation.

FIG. 31 is a photographic view showing cracking in a novel partial-X coupling beam design in a coupled shear wall system, shown during performance testing at 5% rotation.

FIG. 32 is a photographic view showing cracking in the coupling beam of a prior art coupled shear wall system during performance testing, at 6% rotation.

FIG. 33 is a photographic view showing cracking in a novel partial-X coupling beam design in a coupled shear wall system, shown during performance testing at 6% rotation.

FIG. 34 is a photographic view showing cracking in a novel partial-X coupling beam design in a coupled shear wall system, shown during performance testing at 7% rotation.

FIG. 35 is a photographic view showing cracking in a novel partial-X coupling beam design in a coupled shear wall system, shown during performance testing at 8% rotation.

FIG. 36 is a photographic view showing cracking in a novel partial-X coupling beam design in a coupled shear wall system, shown during performance testing at 9% rotation.

The foregoing figures, being merely exemplary, contain various elements that may be present or omitted from actual embodiments which may be implemented for a suitable coupled shear wall system in various buildings, depending upon the circumstances. Further, similar parts may be denoted with similar symbols, but utilizing a "prime" symbol as a suffix—"'"—and these shall be considered the functional equivalent of similar parts without such prime suffix symbols thereafter, as such nomenclatures is utilized in order to avoid unnecessary duplicate explanation of components or of the function thereof. An attempt has been made to draw the figures in a way that illustrates at least those elements that are significant for an understanding of the various embodiments and aspects of the invention. However, various other elements of a suitable coupled shear wall system may be utilized in order to provide a reliable, seismically functional coupled shear wall system that provides suitable lateral stiffness, strength, and ductility, and is thus resistant to shear forces when flexed during seismic events, by exhibiting stable hysteretic response and suitable energy-absorbing characteristics.

DETAILED DESCRIPTION

The term "rebar" is used extensively herein. It should be understood that this term is used to describe any reinforcing bar, as the term is commonly utilized to describe commodity-grade steel used to reinforce concrete in building structures. In various embodiments, rebar is available in various shapes, sizes, lengths, grades, tensile strengths, hardness, and with or without protective corrosion resistant coatings. Rebar is generally utilized to improve the tensile properties of concrete, although it provides strength to such structures in multiple directions based on its configuration. In many embodiments, rebar is provided with a manufactured surface having ribs or ridges that give it better bonding properties with respect to the concrete within which it is embedded.

Figure 1:
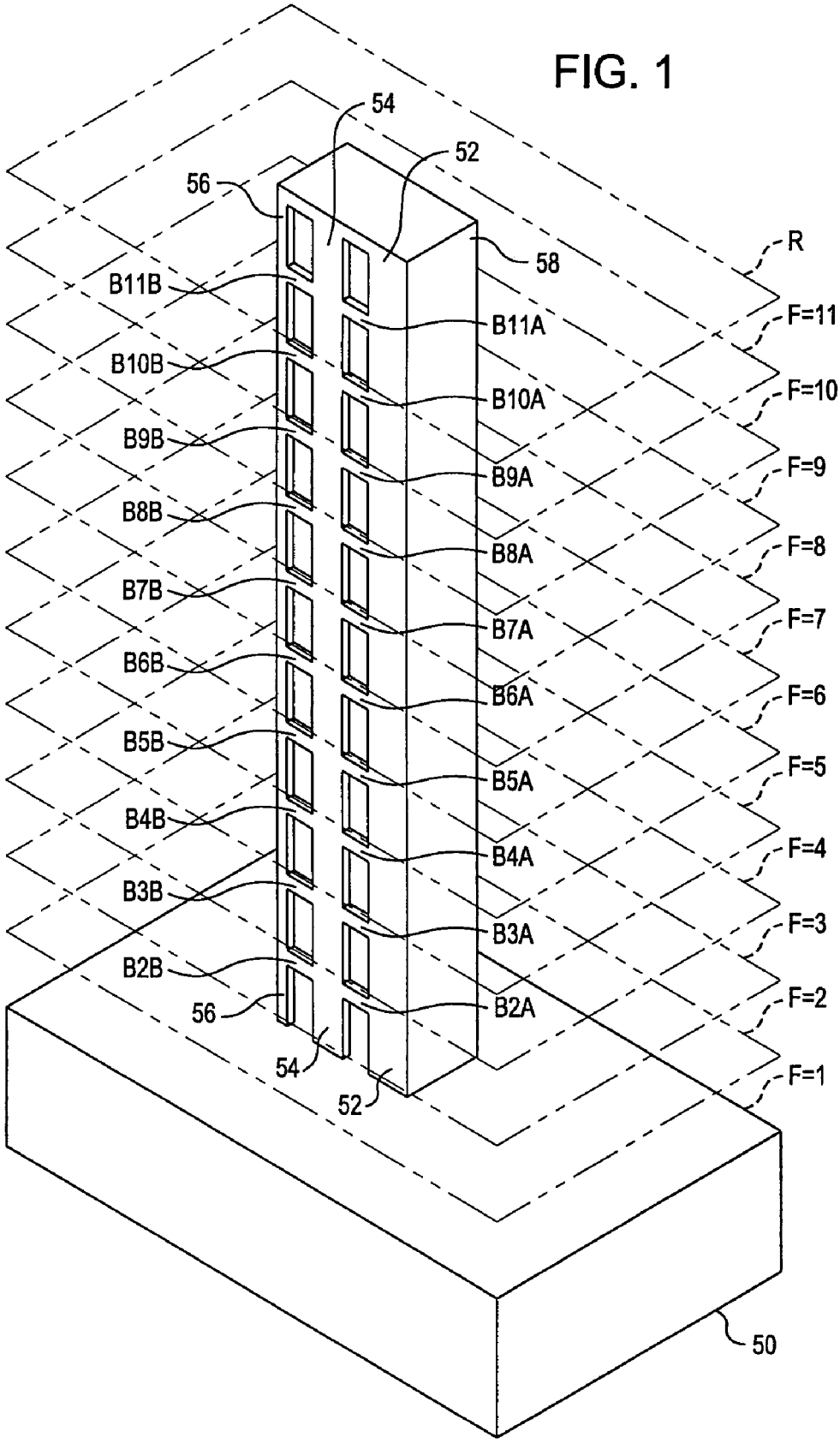
FIG. 1 illustrates a perspective view of a multi-story building have a reinforced concrete core structure, wherein coupling beams are utilized between shear wall segments or columns, and adjacent openings in the core structure, for example, openings into the elevator lobby.
Figure 14:
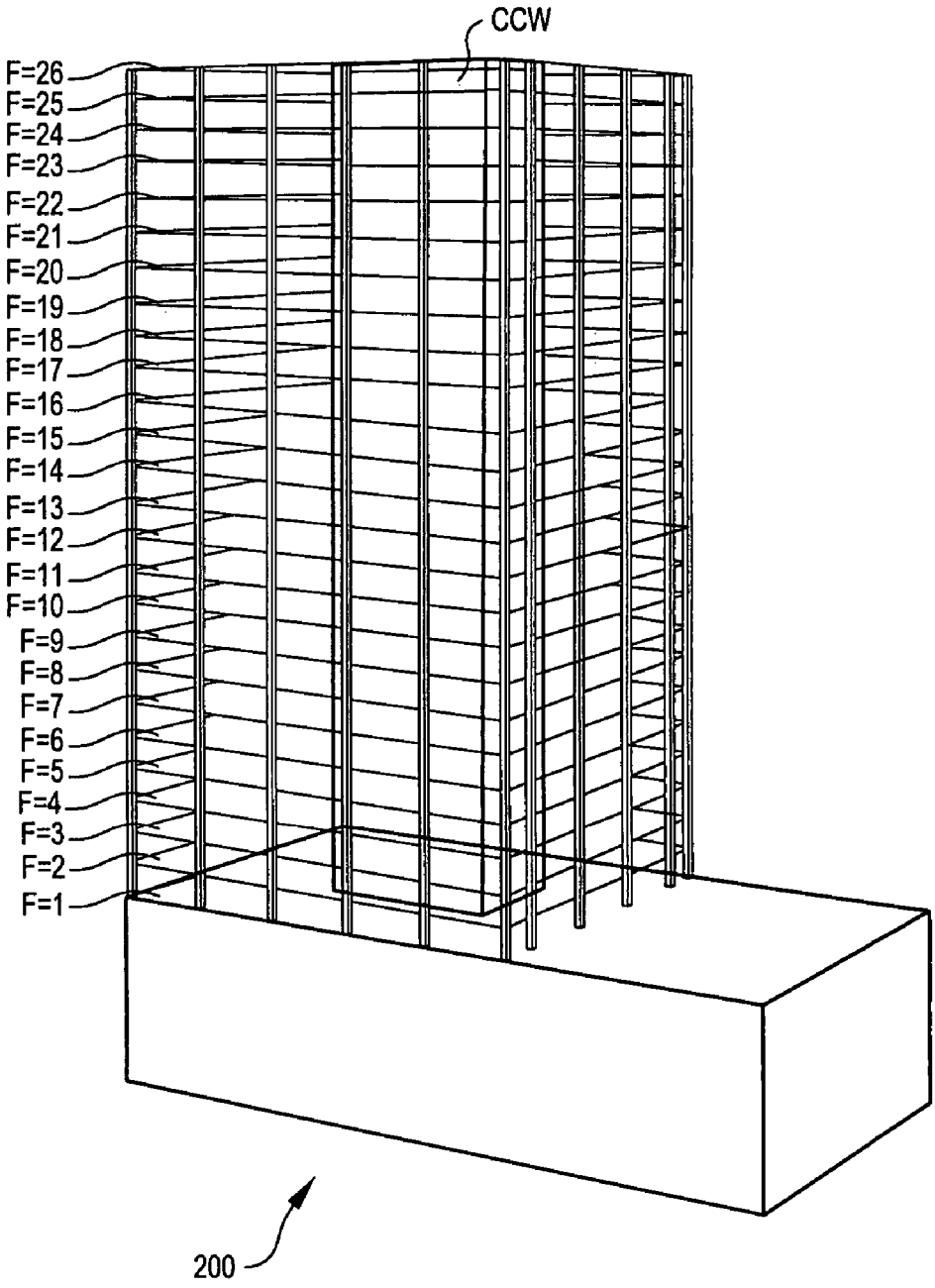
FIG. 14 is a side perspective view of a building utilizing a coupled shear wall system in a building such as that schematically illustrated in FIG. 1 above, now showing in the floor space adjacent the shear walls, for a building that utilizes the partial-X coupling beam design disclosed herein.
Figure 15:
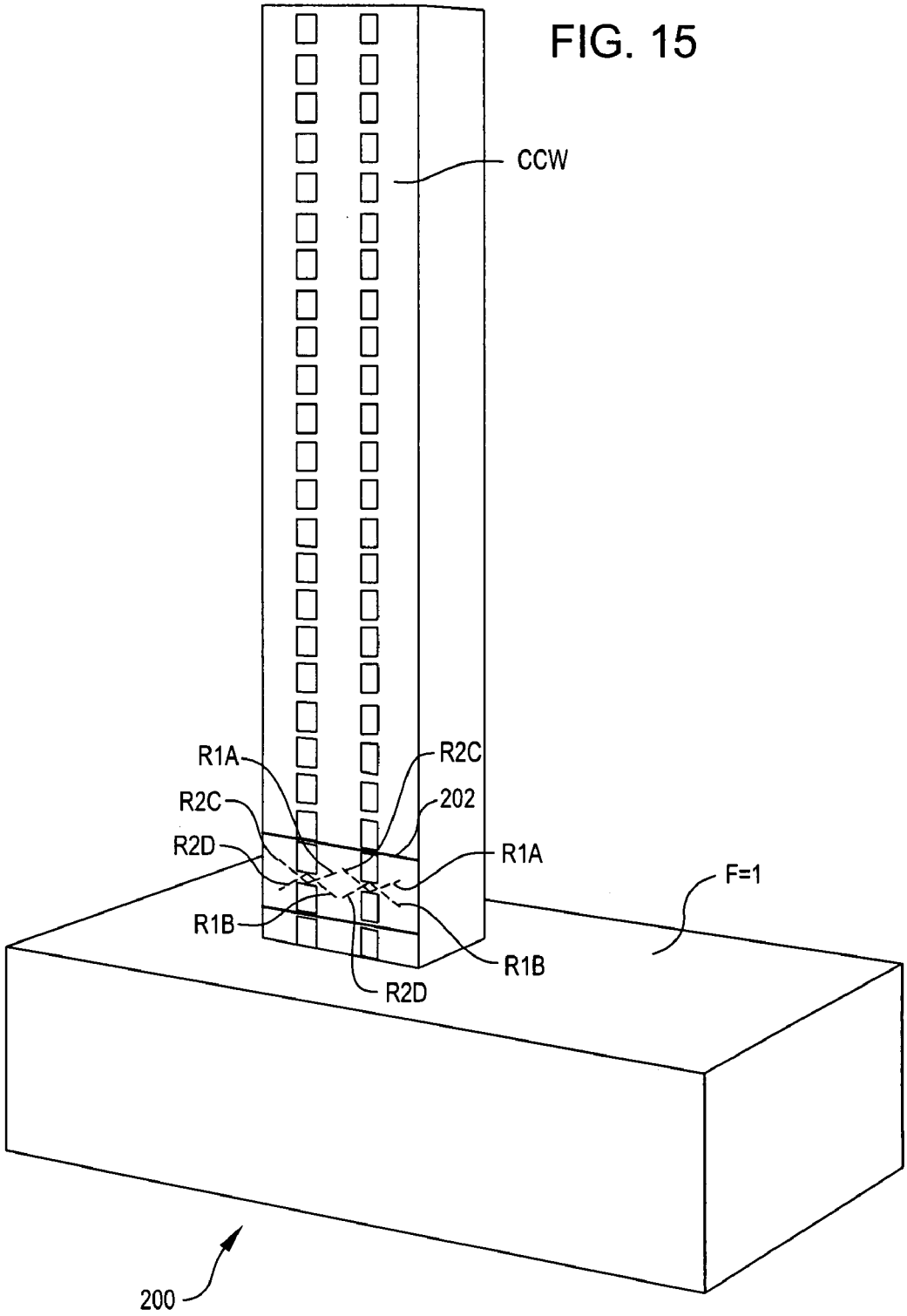
FIG. 15 is a side perspective view of the shear walls and coupling beams in the building just illustrated in FIG. 14, also showing in one of the lower floors the schematic representation of the location of an embodiment for a partial-x coupling beam design.

Turning now to FIG. 1, a partial perspective view is provided of one embodiment for a multi-story building 50 that utilizes a coupled shear wall system. The multi-story building 50 has a plurality of floors F in a series of floors F from 1 to N, where N is a positive integer. As shown in FIG. 1, N equals 11, as the building 50 is shown with and uppermost floor F wherein F equals 11. For illustrative purposes, in this FIG. 1, each of the hidden lines indicating floors 2 though 11 can be considered to represent a floor slab, as can be better appreciated by reference to FIG. 14. In any event, in the illustration provided by FIG. 1, above floor 11 is a roof R. The coupled shear wall system includes a first wall 52, a second wall 54, and a third wall 56. One or more coupling beams, here B2A and B2B for example as shown below floor 2, are utilized, typically at each floor level, The first coupling beam B2A couples the first wall 52 with the second wall 54, and the second coupling beam B2B couples the second wall 54 with the third wall 56, thus providing a coupled shear wall system for a portion of the core walls 58 that, in this embodiment, provide structural housing for at least an elevator shaft, or more generally, one or more elevator shafts and other utilities or facilities provided for the multi-story building 50.

At each higher building floor F in the series of building floors from 1 to N, additional coupling beams are provided, and are in FIG. 1 labeled sequentially by floor in the same fashion as the B2A and B2B below the second floor, and as such, are noted as coupling beams B3A and B3B, for example, up through B11A and B11B, in the illustrated case where the number of floors N equals 11.

Figure 2:
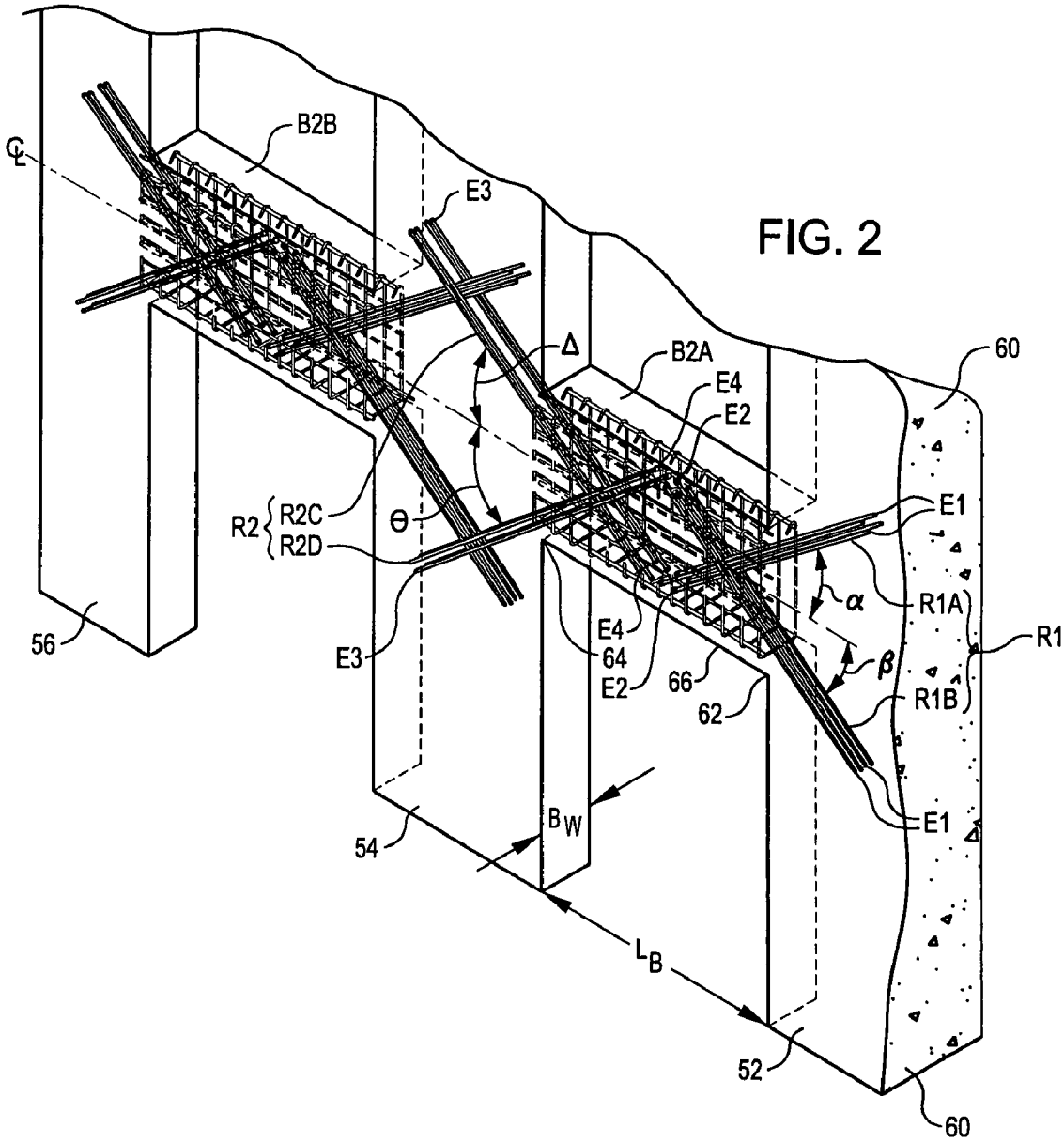
FIG. 2 illustrates an enlarged perspective view of the use of two novel coupling beams, shown as installed in the core structure just shown in FIG. 1, now showing a "partial-X" design for the reinforcing steel in each of the coupling beams, in accordance with an embodiment of the invention.

As better seen in FIG. 2, in one exemplary embodiment, coupling beams, such as beams B2A and B2B, are constructed utilizing concrete 60 and reinforcing bar R. In such an embodiment, a coupling beam such as beam B2A includes a first group R1 of reinforcing bar R and a second group R2 of reinforcing bar R.

The first group R1 of reinforcing bar R includes a first set R1A having a one or more reinforcing bars R, and in most embodiments a plurality of reinforcing bars R, and a second set R1B having one or more reinforcing bars R, and in most embodiments, a plurality of reinforcing bars R. In one embodiment, the first set R1A and second set R1B each include two or more lengths of rebar R. As illustrated in FIG. 2, the first set R1A is inclined upwardly and the second set R1B is inclined downwardly. Each of the bars R in the first group R1 of reinforcing bars R have first ends E1 and second ends E2. At least some of the first ends E1 are located within the first wall 52. At least some of the second ends E2 are located within the coupling beam B2A.

The second group R2 of reinforcing bar R includes a third set R2C having one or more reinforcing bars R, and in most embodiments, a plurality of reinforcing bars R, and a fourth set R2D having one or more reinforcing bars R, and in most embodiments, a plurality of reinforcing bars R. In one embodiment, the third set R2D and fourth set R2D each include two or more lengths of rebar R. As illustrated in FIG. 2, the third set R2C is inclined upwardly and the fourth set R2D is inclined downwardly. Each of the bars R in the second group R2 of reinforcing bars have first ends E3 and second ends E4. At least some of the first ends E3 are located within the second wall 54. At least some of the second ends E4 are located within the coupling beam B2A.

Figure 7:
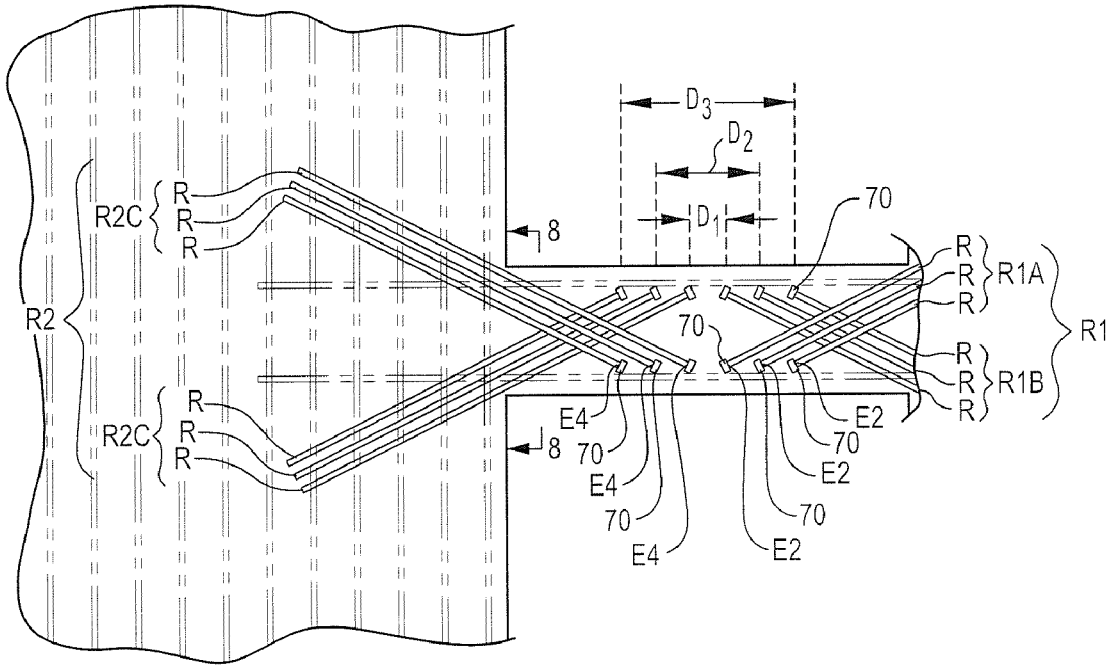
FIG. 7 is a "see-through" side view of reinforcing steel that may be utilized in a coupling beam that utilizes my "partial-X" design for the reinforcing steel in the coupling beam, similar to FIG. 6 above, but now shown without the transverse reinforcing steel cage around the beam, for ease of illustration of the "partial-X" design for the reinforcing steel groups utilized for development of strength of the coupling beam.

In the embodiment illustrated in FIG. 2, each of the second ends E2 of the first group R1 of reinforcing bar R may be spaced apart from the fourth ends E4 of said second group R2 of reinforcing bar R. Examples of embodiments with such a spaced apart relationship may be better seen by reference to FIG. 7, wherein spacing distance D1, or spacing distance D2, or spacing distance D3 may be provided, depending upon the location of a specific rebar R having second ends E2 or fourth ends E4. More fundamental, however, is the inventive concept that most if not all of the inclined rebar R is provided in a manner which does not fully extend across the length $L_B$ of the beam B2A. Ideally, for ease of construction, none of the key inclined rebar R (for example, in sets R1A or R1B) is provided in a manner fully extending across the length $L_B$ of the beam B2A.

In one embodiment, as seen in FIG. 2, the coupled core wall system includes a coupling beam such as beam B2A, having a first end 62, a second end 64, and a central portion 66. The coupling beam B2A extends for a length $L_B$ between the first end 62 and the second end 64. The coupling beam B2A has a width of $B_W$. The second ends E2 of the first group R1 of reinforcing bar R and the fourth ends E4 of the second group R2 of reinforcing bar R are located within the central portion 66 of the coupling beam B2A.

A suitable angle of inclination can be selected for the first set R1A of reinforcing bar. As noted in FIG. 2, the first set R1A of said reinforcing bar R is inclined upwardly at an angle alpha ($\alpha$). Similarly, the second set R1B of reinforcing bar R is inclined downwardly at an angle beta ($\beta$). And, the third set R2C of reinforcing bar R is inclined upwardly at an angle delta ($\Delta$). Finally, the fourth set R2D is inclined downwardly at an angle theta ($\theta$). For reference with respect to the aforementioned angles, in FIG. 2, a horizontal centerline $C_L$ is provided, although it must be understood that the construction of a coupling beam in accord with the teachings hereof may be provided in a manner not necessarily centered about a horizontal coupling beam centerline. However, for reference purposes, each of the aforementioned angles of inclination for an inclined or diagonal rebar set (e.g., first set R1A or second set R1B) is the angle measured from the horizontal.

As illustrated in FIG. 2, in some embodiments, it may be appropriate to configure the construction of a coupling beam such as beam B2A in a manner such that the first set R1A of reinforcing bar R is inclined upwardly at an angle alpha ($\alpha$), and wherein the second set R1B of reinforcing bar R is inclined downwardly at an angle beta ($\beta$), wherein the angle alpha ($\alpha$) and the angle beta ($\beta$) are equal and opposite. Likewise, in some embodiments, it may be appropriate to configure the construction of a coupling beam such as beam B2A in a manner such that the third set R2C of reinforcing bar R is inclined upwardly at an angle delta ($\Delta$), and wherein the fourth set R2D of reinforcing bar R is inclined downwardly at an angle theta ($\theta$), wherein the angle delta ($\Delta$) and the angle theta ($\theta$) are equal and opposite.

In one embodiment, suitable angles for angle alpha ($\alpha$), angle beta ($\beta$), angle delta ($\Delta$), and angle theta ($\theta$), range from about sixty (60) degrees to about fifteen (15) degrees. In another embodiment, suitable angles for angle alpha ($\alpha$), angle beta ($\beta$), angle delta ($\Delta$), and angle theta ($\theta$), range from about thirty (30) degrees to about forty five (45) degrees. Of course, if the first group of rebar R1 and the second group of rebar R2 are selected so that R1 and R2 do not overlap within beam B2A, then a suitable maximum angle can be easily calculated, once an adequate allowance is made for the other reinforcing materials, further discussed hereinbelow, which are also utilized to construct a suitable coupling beam such as beam B2A. In some embodiments, it may be advisable to construct a coupled shear wall system having a coupling beam wherein one or more of said inclination angles alpha, beta, delta, and theta, are larger by a factor of about two, or more, compared to a maximum possible inclination angle zeta (Z) that would be achievable if a continuous rebar extending fully across the length of the coupling beam B2A were used and developed into the adjacent shear walls 52 and 54.

As better seen in any one of FIG. 5, 6, 7, or 13, in order to provide additional strength against pullout of rebar R, in one embodiment, any one or more of the second ends E2 of said first group R1A of reinforcing bar R may further include a mechanical end anchor 70. In some embodiments, each one of the second ends E2 of the first group R1 of reinforcing bar R may include a mechanical end anchor 70. Similarly, in one embodiment, one or more of the fourth ends E4 of the second group R2 of reinforcing bar R may further include a mechanical end anchor 70. In one embodiment, each of the second group R2 of reinforcing bars R further includes a mechanical end anchor 70.

Mechanical end anchors 70 may be provided in a variety of configurations as will be understood to those of ordinary skill in the art and to which this specification is addressed. As seen in FIG. 13, for example, mechanical end anchors 70 may have a generally cylindrical body 72 to which a rebar R is affixed. In one embodiment, the mechanical end anchors may be provided in a generally annular configuration with interior surface 74, which may in some embodiments provide threads for connection to an end E2 or E4 of rebar R. One supplier for a basic mechanical end anchor 70 as illustrated in FIG. 13 is ERICO International Corporation's Lenton® brand terminator (ERICO located at Solon, Ohio, USA; see http://www.erico.com), that is normally provided with an internal tapered thread (shown as hidden lines 76 in FIG. 13) to attach the end anchor 70 to the rebar R. Such mechanical end anchors are described as over-sized end anchors that are secured to the end of a length of reinforcing steel R, thus creating anchorage within the concrete 60, and reducing congestion within the concrete beam (e.g. B2A), as compared to use of alternate designs such as hooks.

Figure 13A:
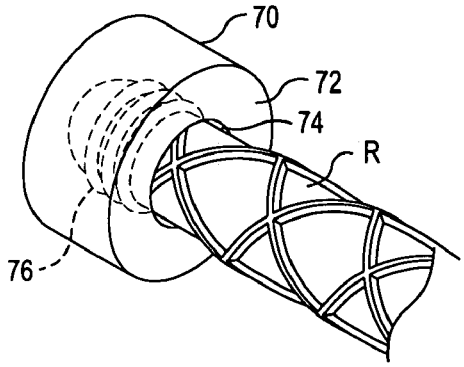
FIG. 13(A) illustrates the use of one type of mechanical end anchor that is secured to the end of a length of reinforcing steel, to create an anchorage within the concrete similar to the standard hook shown in FIG. 12, however, the use of such anchors also helps reduce steel congestion and simplifies construction with respect to the standard hook just shown in FIG. 12.
Figure 13B:
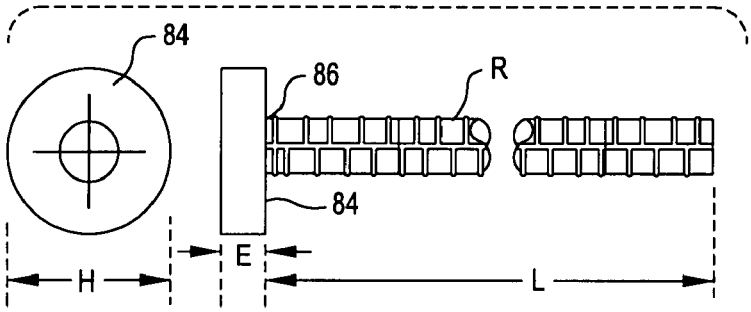
FIG. 13(B) illustrates the use of a headed rebar, utilizing annular end head to secure the end of a length of reinforcing steel within concrete, to create an anchorage within the concrete.
Figure 13C:
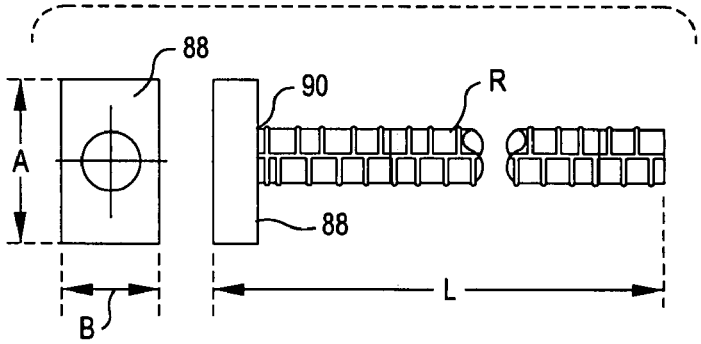
FIG. 13(C) illustrates the use of a headed rebar, utilizing a rectangular end head to secure the end of a length of reinforcing steel within concrete, to create an anchorage within the concrete.
Figure 13D:
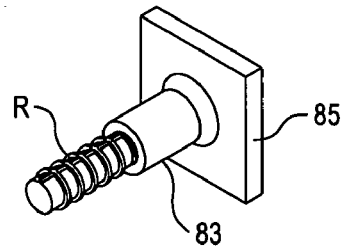
FIG. 13(D) illustrates the use of a headed rebar, utilizing a square end head to secure the end of a length of reinforcing steel within concrete, to create an anchorage within the concrete.

It will be understood by those of ordinary skill in the art that other devices may be utilized as mechanical end anchors without departing from the basic teachings herein. For example, headed bars 80, as shown in FIG. 13(C), or 82 as shown in FIG. 13(D), may be utilized, and in such cases, the headed bars 80 or 82 may be affixed to rebar R by threaded configuration as illustrated in FIG. 13(D), including the use of couplers where appropriate, or threaded adapters 83, or by welding as illustrated in FIG. 13(C). Also, as shown in FIGS. 13(B), a round head 84 may be welded to rebar R by weldment 86. The actual shapes of headed bars may include round heads 84, or other shape such as a rectangular 85 (see FIG. 13(C)) or square (see FIG. 13(D)) shaped parallelepiped heads. Such heads as rectangular head 88 may be welded by weldment 90 to rebar R.

Mechanical anchors are used with many reinforcing bars. Such mechanical anchoring devices may include cylindrical, oval, rectangular, square, or other shaped structures at one or both ends of the reinforcing bar, in order to provide anchorage in concrete. Connection between the reinforcing bars and the mechanical anchors may be established by forging, threading, welding, crimping, screwing, or other methods or structures.

Mechanically headed reinforcing bars are sometimes provided in various concrete structures, as will be understood by those of ordinary skill in the art and to whom this specification is addressed. Reinforcing bars with cylindrical, oval, rectangular, or square anchoring devices are attached at one or both ends of the reinforcing bar that provides anchorage in or confinement of concrete. The reinforcing bars may be attached to the anchoring devices by forging, threading, welding, crimping, screwing, or other methods or structures.

Figure 5:
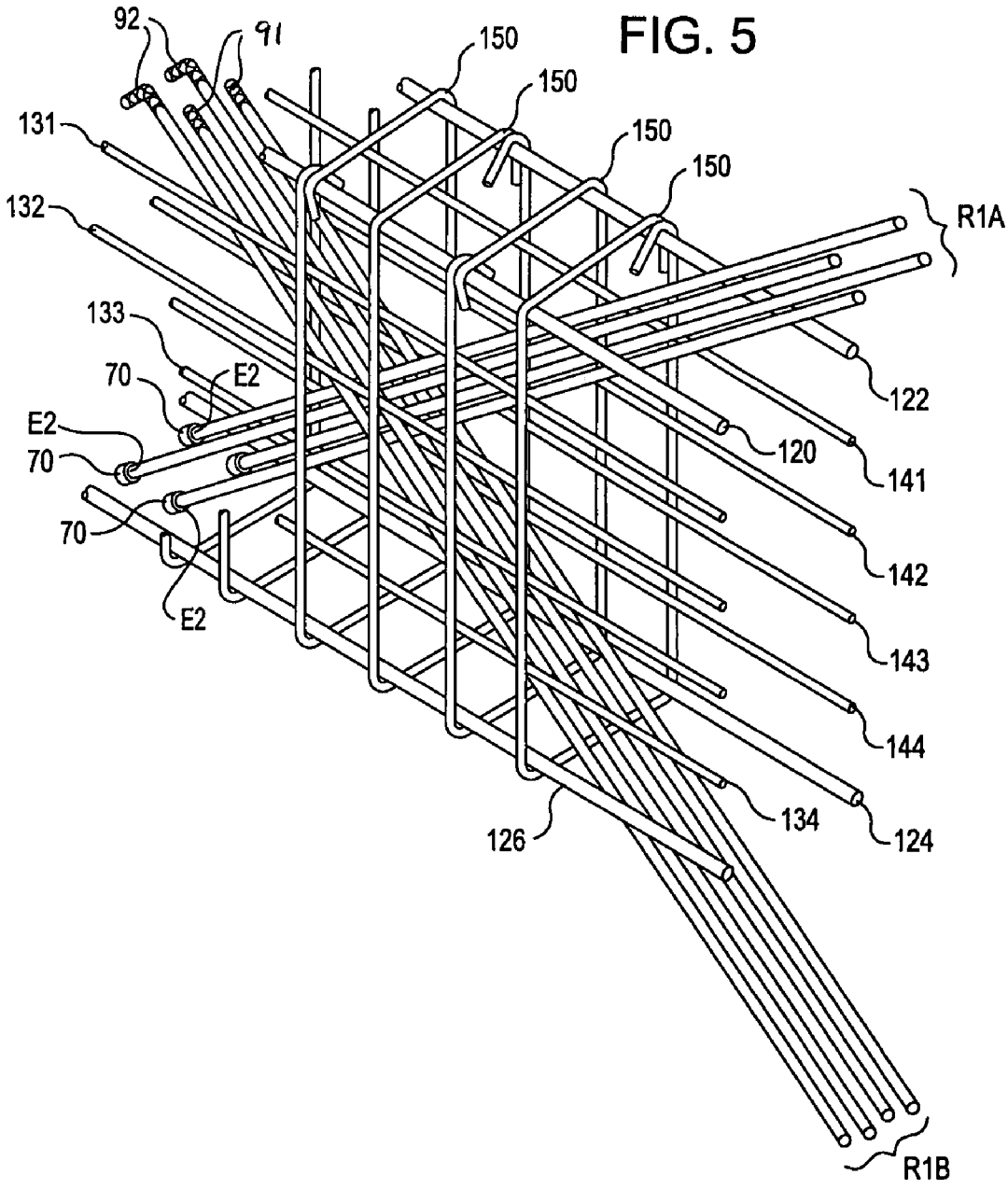
FIG. 5 is an enlarged partial perspective view of portions of reinforcing steel that may be utilized in one side of a coupling beam that utilizes a "partial-X" design for the reinforcing steel in the coupling beam.
Figure 11:
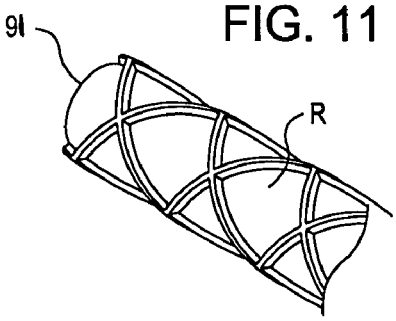
Figure 12:
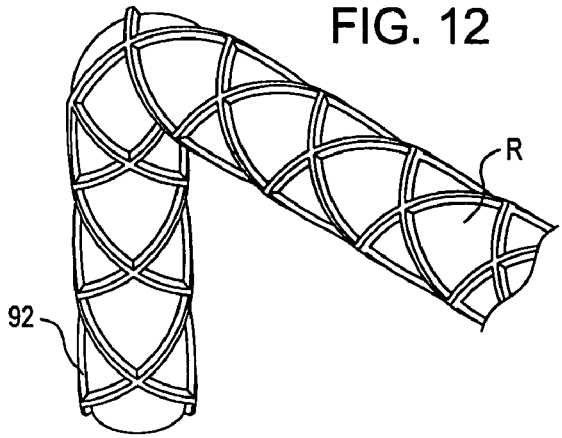

Alternately, as is illustrated in FIG. 5, one or more of the second ends E2 of the first group R1, or one or more of the fourth ends E4 of the second group R2, may utilize a straight linear rebar 91 end configuration. Such a straight linear rebar 91 configuration is shown in more detail in FIG. 11. Likewise, one or more of the second ends E2 of the first group R1, or one or more of the fourth ends E4 of the second group R2, may utilize a standard hook 92 configuration. Such a standard hook configuration is shown in more detail in FIG. 12. Although not shown in FIG. 5, for clarity of the components that are actually illustrated, cross-ties may additionally be utilized.

Figure 8:
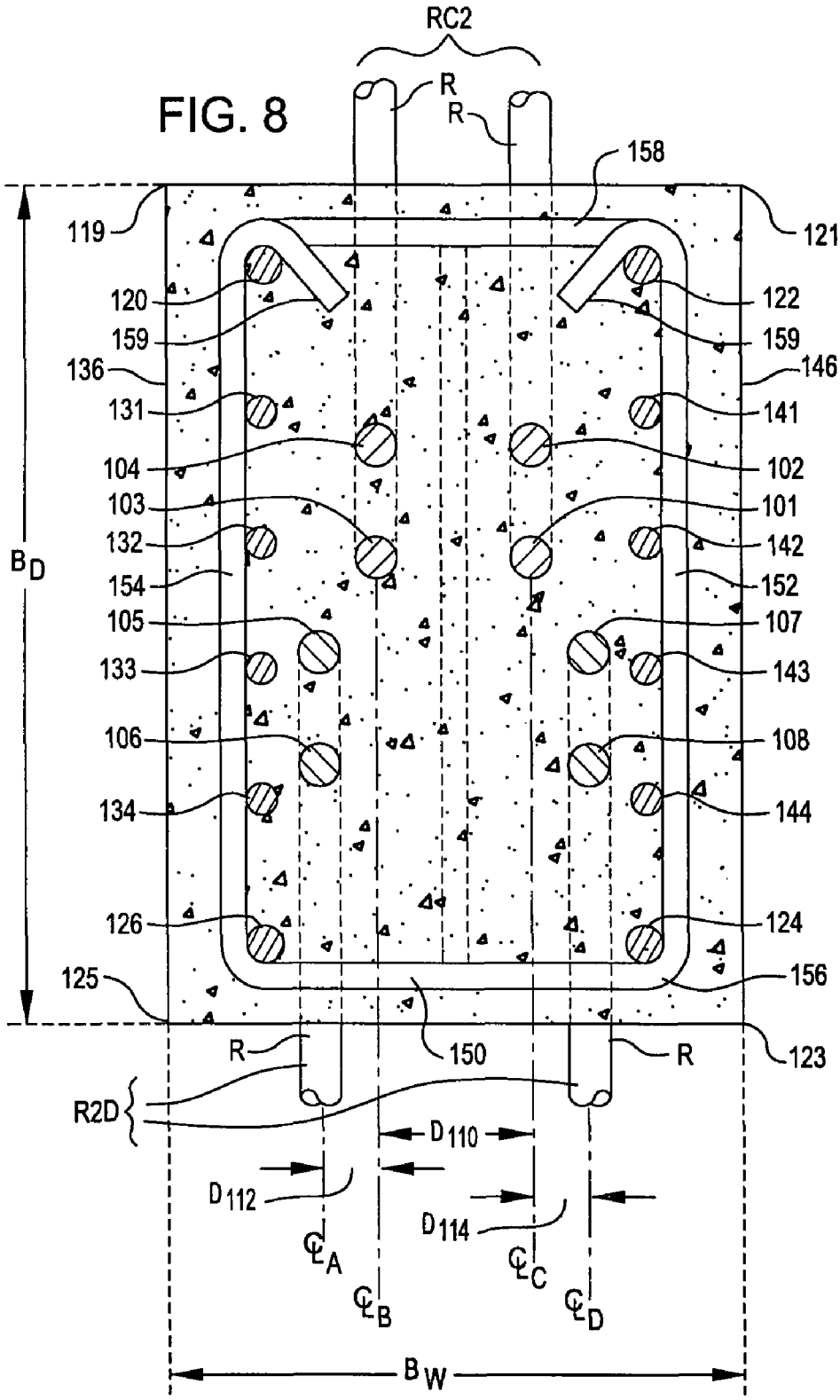
FIG. 8 is a cross-sectional view of a coupling beam, taken as if through line 8-8 of FIG. 7, showing one suitable design for placement of the transversely oriented reinforcing steel, showing hoops with hook ends across longitudinally extending reinforcing steel, as well as showing in cross-section and hidden lines the orientation and location of diagonally extending reinforcing steel.
Figure 9:
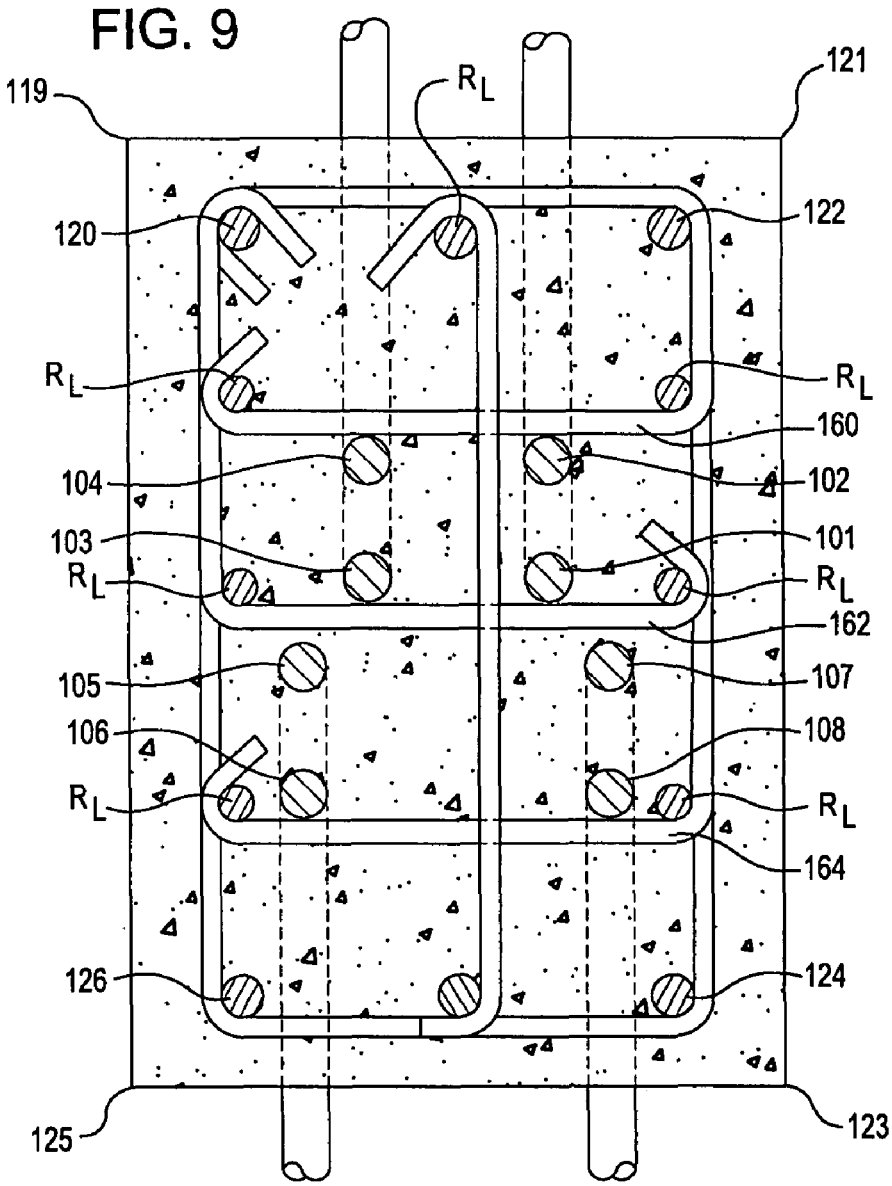
FIG. 9 is similar to FIG. 8, and may also be considered as if taken through line 9-9 of FIG. 6, however, in this view, alternate designs for transversely oriented reinforcing steel are shown, now conceptually depicting various designs with 135 degree hook ends, the exact details of which are sometimes specified by code requirements or by local custom, but which need not be further described to those of ordinary skill in the art and to which this disclosure is directed.
Figure 10:
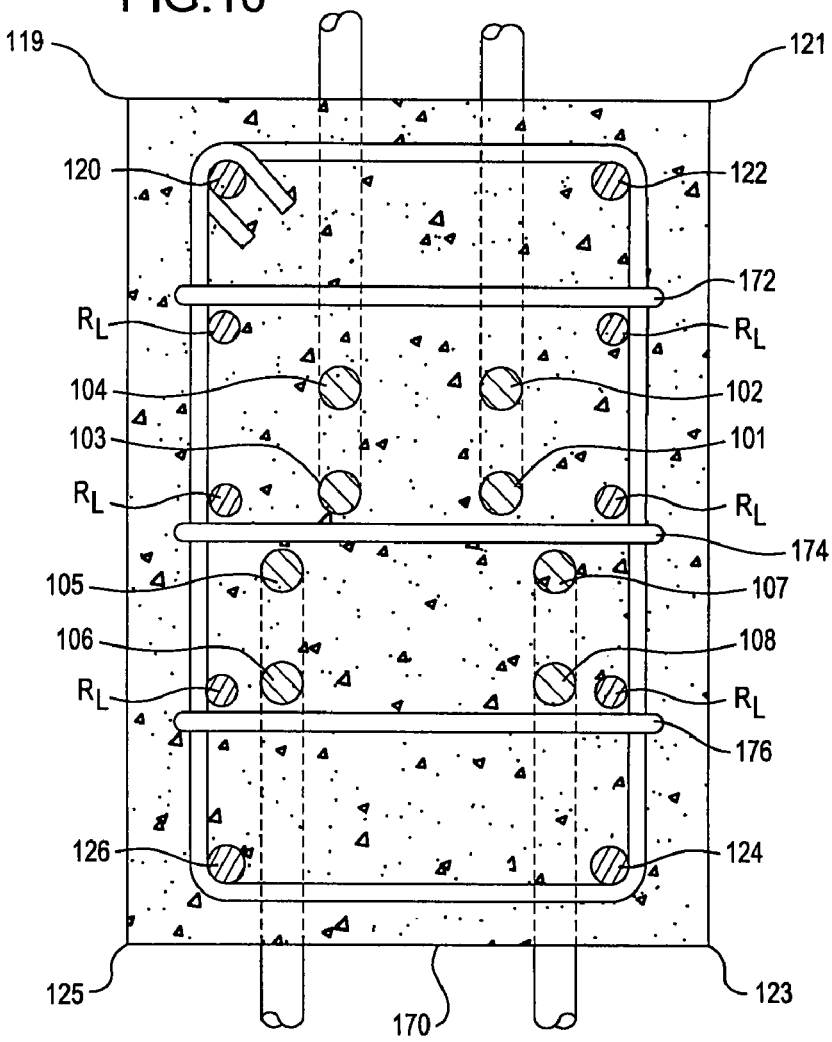
FIG. 10 is similar to FIG. 9, and may also be considered as if taken through line 9-9 of FIG. 6, however, in this view, still further alternate designs for providing transversely oriented reinforcing steel are shown, now conceptually depicting a hoop design with horizontal cross-ties anchored around the hoop member to provide confining structure around the reinforced concrete coupling beam.

Turning now to FIGS. 8, 9, and 10, three similar configurations are provided to show alternative internal reinforcement for a coupling beam, especially in the transverse direction. A coupling beam having a width $B_W$ and a depth (height) of $B_D$ is provided. Each of FIGS. 8, 9, and 10 are shown as if taken across section 8-8 of FIG. 6. First, in FIG. 8, spacing of the partial-X reinforcing bars R is illustrated. Here, the third set R2C and the fourth set R2D of reinforcing bars R (see FIG. 7) are shown transversely spaced apart. As illustrated, the third set R2C includes a first rebar 101 of diameter D101, a second rebar 102 of diameter D102, a third rebar 103 of diameter D103, and a fourth rebar 104 of diameter D104. The fourth set R2D includes a fifth rebar 105 of diameter D105, a sixth rebar 106 of diameter D106, a seventh rebar 107 of diameter D107, and an eighth rebar 108 of diameter D108. Rebars 101 and 102 are located along centerline C. Rebars 103 and 104 are located along centerline B, spaced apart from rebar 101 and 102 by a centerline distance of D110. Rebars 105 and 106 are located along centerline A. Rebars 105 and 106 are located spaced transversely (and as illustrated, outwardly) from rebar 103 and rebar 104 by a centerline distance of D112. Rebars 107 and 108 are located along centerline D. Rebars 107 and 108 are located spaced transversely (and as illustrated, outwardly) from rebar 101 and 102 by a centerline distance of D114. As illustrated in FIG. 8, the third set R2C of reinforcing bars R, namely rebars 101, 102, 103, and 104, are located between, within the coupling beam B2A, the fourth set of reinforcing bars, namely, rebars 105, 106, 107, and 108.

Figure 6:
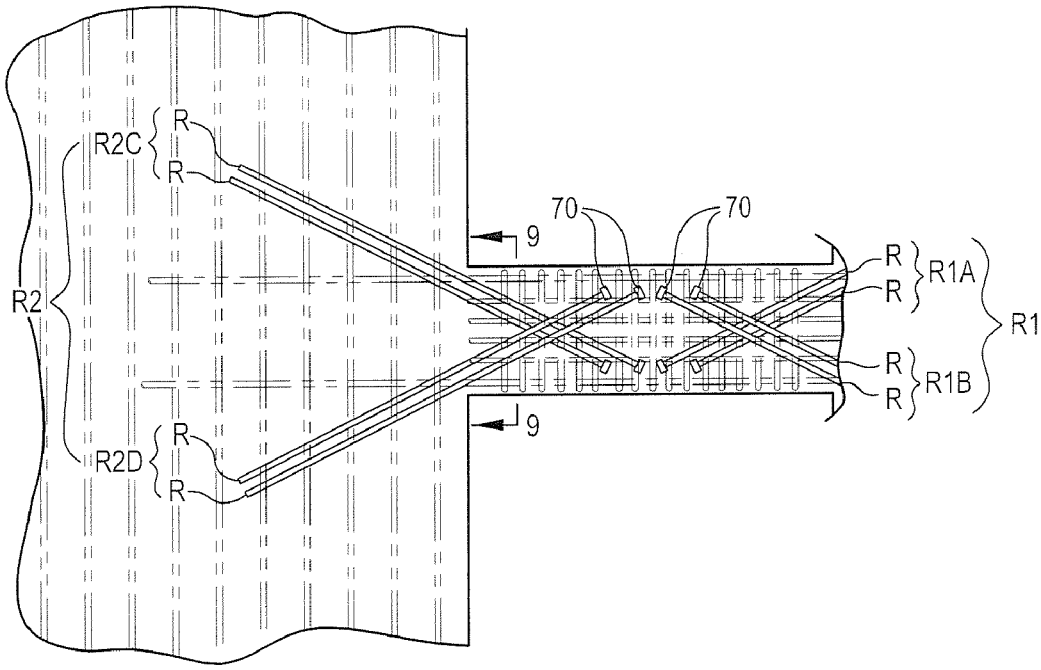
FIG. 6 is a "see-through" side view of reinforcing steel that may be utilized in a coupling beam that utilizes a "partial-X" design for the reinforcing steel in the coupling beam.

Although not shown, it can be appreciated from FIG. 6 and comparison with FIG. 8 that a mirror image section, if taken at the opposite end of beam B2A from the location where section 8-8 is taken, would also show that the first set R1A and the second set R2A of reinforcing bars R are also transversely spaced apart in a similar manner as just described above with respect to the third set R2C and the fourth set R2D of rebars R.

Also illustrated in FIGS. 8, 9, and 10 is the use in a coupling beam of a plurality of longitudinally extending reinforcing bar. Such longitudinally extending reinforcing bar includes, adjacent the upper front corner 119 a rebar 120 of diameter D120. Adjacent the upper rear corner 121 a rebar 122 of diameter D122 is provided. Adjacent the lower rear corner 123 of the coupling beam, rebar 124 of diameter D124 is provided. Adjacent the lower front corner 125, rebar 126 of diameter D126 is provided. In one embodiment, such longitudinally extending reinforcing bar 120, 122, 124, and 126 extends across the coupling beam B2A, from within the first wall 52 to within the second wall 54.

Further, as illustrated in FIGS. 8, 9, and 10, additional longitudinally extending reinforcing bars are provided, namely bars 131, 132, 133, and 134 of diameter D131, D132, D133, and D134, respectfully, adjacent the front 136 of beam B2A, and bars 141, 142, 143, and 144 of diameter D141, D142, D143, and D144, respectfully, adjacent the back 146 of beam B2A.

Figure 3:
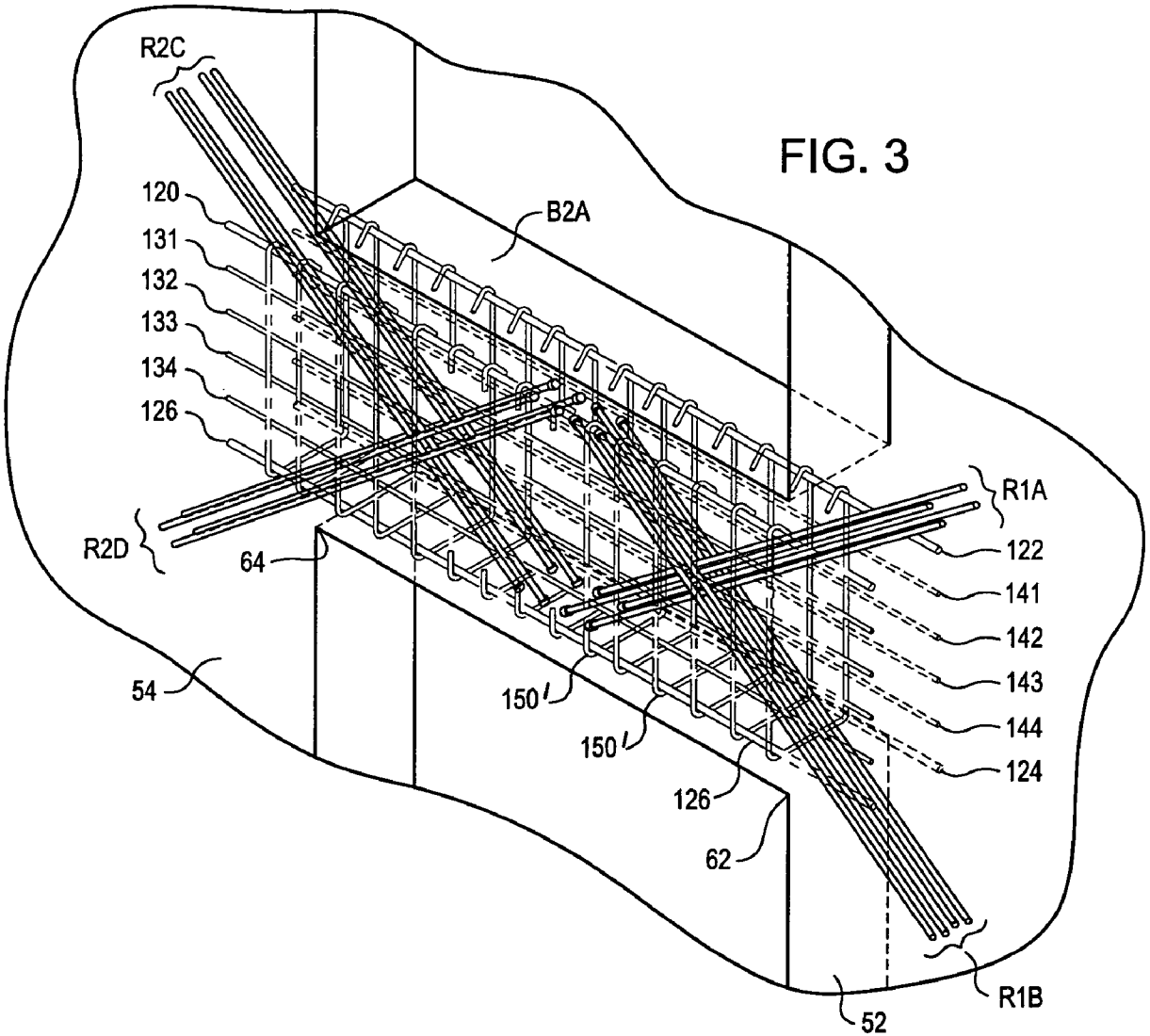
FIG. 3 illustrates an enlarged perspective view of one coupling beam design, similar to the view just shown in FIG. 2, but here illustrating the details of a single beam utilizing the "partial-X" design for the reinforcing steel in the coupling beam.
Figure 4:
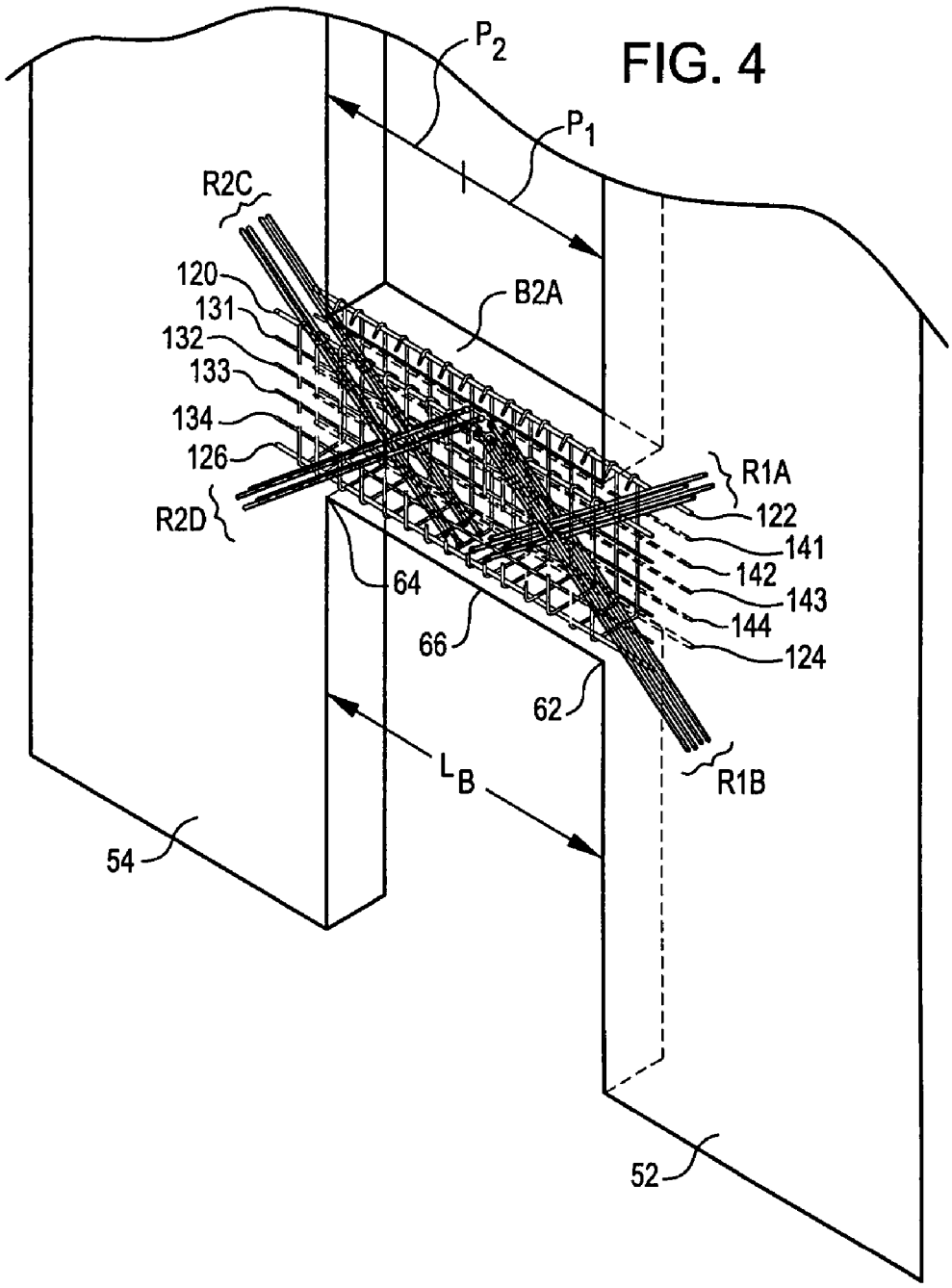
FIG. 4 provides yet another perspective view of a coupling beam, similar to the view shown in FIG. 3, showing the use of a single beam utilizing the "partial-X" design for the reinforcing steel in the coupling beam.

As shown in FIG. 8, additional reinforcement in the form of a hoop 150 may be provided, wherein the hoop 150 includes vertical components 152 and 154, as well as transverse horizontal components 156 and 158, as well as hook ends 159. Placement of hoops 150 can be seen by reference to FIG. 5, or by reference to a slight variation shown as hoops 150' in FIG. 3.

Another variation on a pattern for additional reinforcement is provided in FIG. 9, wherein a plurality of horizontal transverse reinforcing components 160, 162, and 164 are spaced apart vertically across the coupling beam. Further, in FIG. 9, a plurality of vertical reinforcement components 166 and 168 are shown spaced apart horizontally across the coupling beam. In FIG. 9, the horizontal components 160, 162, and 164 may be considered cross-ties that confine, extend between, and therefore contain any selected two or more of the longitudinally extending reinforcing bars.

Yet another variation on a pattern for additional reinforcement is provided in FIG. 10, where a hoop 170 is secured by a plurality of cross ties, namely cross-ties 172, 174, and 176. Also, other longitudinally extending reinforcing bars have been merely labeled as $R_L$.

At least some of the substantially vertically oriented transverse reinforcing components may be selected from the group consisting of (a) stirrups, (b) closed stirrups, (c) hoops, and (d) cross ties. Further, the substantially vertically oriented transverse reinforcing components may generally be provided in metal rebar configurations. More generally, in coupling beams, in additional to longitudinal bars, reinforcing may include vertical and/or horizontal reinforcing elements. Such elements may consist of one or more of (a) stirrups, (b) hoops, (c) cross-ties, (d) mechanically headed bars, and (e) reinforcing fibers.

Stirrups is the name used in the reinforcing steel industry for reinforcement elements that are used to resist shear and torsion stresses in a structural member, and typically refers to bars, wires, or welded wire reinforcement, either with a single leg, or bent into L, U, or rectangular shapes, generally for containment of other rebar. Hoops are continuous rebar ties, or a combination of a plurality of reinforcing elements each having seismic hooks at one or more of their ends, and that together may form a continuous closed tie. In an embodiment, cross-ties may be provided as continuous reinforcing bars having a seismic hook at one end and a hook not less than ninety (90) degrees with at least a six-inch diameter extension at the other end. Such hooks may be utilized to engage peripheral longitudinal bars, or to engage transverse bars. In another embodiment, a pair of reinforcing bars may be used, each with a seismic hook at one end, or at opposing ends, and then spliced so as to be functional as one rebar element.

Further, in addition to the various rebar and rebar reinforcing components just described, reinforcing fibers including nylon, polypropylene, steel, and/or other materials, may be mixed into concrete to provide enhanced strength properties of the concrete. Generally, such concrete additive materials are used to increase strength, or to achieve crack width reduction during seismic or other failure events, and when elongated materials are used, the improvement provided is often in a manner similar to the effect provided by reinforcing bars.

Attention is now directed to FIGS. 14, 15, 16, and 17, wherein various aspects of a layout for a building 200 wherein a coupled shear wall system utilizing the teachings herein may be advantageously utilized. A shear wall is a wall, usually concrete, that is used to resist lateral forces. A coupled shear wall comprises two or more shear walls linked by one or more coupling beams in a manner such that the two or more shear walls and the one or more coupling beams resist lateral forces as a unit, thus utilizing the strength and performance of the combined coupled shear wall system. Often, as in building 200, a coupled core wall (CCW) is utilized at the interior of the building 200, for construction of a central shaft, normally housing elevators for the building 200. Schematically in FIG. 15, a box 202 is highlighted at the coupled core wall (CCW), to identify the general location of the coupled shear wall previously described in great detail with respect to FIG. 2 and accompanying description thereof. As further seen in FIG. 14, the building 200 utilizes a plurality of floors above the base floor 1; here, 25 floors are shown, plus a roof deck at F=26.

As noted earlier, a coupled shear wall system is utilized, including a first wall 52, a second wall 54, and a coupling beam that couples the first wall 52 with the second wall 54. The first wall 52, the second wall 54, and each of one or more, and normally a plurality of coupling beams, each comprising reinforcing bar and concrete, are provided. The reinforcing bar in each of the coupling beams includes a first group R1 of intersecting diagonally placed reinforcing bar extending across a first portion P1 of the length $L_B$ of the coupling beam. The first group R1 of intersecting diagonally placed reinforcing bars includes a first set R1A of reinforcing bars R and a second set R1B of reinforcing bars R. A second group R2 of intersecting diagonally placed reinforcing bars extend across a second portion P2 of the length $L_B$ of the coupling beam. The second group R2 of intersecting diagonally placed reinforcing bars R comprises a third set R2C of reinforcing bars R and a fourth set R2D of reinforcing bars R. The first group R1 of intersecting diagonally placed reinforcing bars R are anchored within the first wall 52. The second group R2 of intersecting diagonally placed reinforcing bars R are anchored within the second wall 54. The first group R1 and the second group R2 of intersecting diagonally placed reinforcing bars R each include ends that are anchored within the coupling beam. Further, in one embodiment, the first group R1 includes second ends E2 within the coupling beam, and the second group R2 includes fourth ends E4 within the coupling beam, and each of the second ends E2 of the first group R1 of reinforcing bar R are spaced apart from the fourth ends E4 of the second group R2 of reinforcing bar R.

Thus, a multi-story building 200 having multiple floor levels 1 though N (where N is a positive integer) may be advantageously constructed utilizing a coupled shear wall system in accord with the teachings herein. In such a method, a coupled shear wall is formed at a first level or location. The coupled shear wall includes, between at least some levels, a first shear wall, a second shear wall, and a coupling beam that couples the first wall with the second wall. The first wall, second wall, and coupling beam each are constructed utilizing reinforcing steel and concrete. The reinforcing steel includes (1) a first group of intersecting diagonally placed reinforcing bars extending across a first portion P1 of the length of the coupling beam, the first group of intersecting diagonally placed reinforcing bars including a first set and a second set of reinforcing bars, and (2) a second group of intersecting diagonally placed reinforcing bars extending across a second portion P2 of the coupling beam, said second group of intersecting diagonally placed reinforcing bars including a third set and a fourth set of reinforcing bars. The first group R1 of intersecting diagonally placed reinforcing bars are anchored within the first wall 52. The second group of intersecting diagonally placed reinforcing bars are anchored within the second wall 54. The first group R1 and the second group R2 of intersecting diagonally placed reinforcing bars are each anchored within the coupling beam. In one embodiment, each of the second ends E2 of the first group R1 of reinforcing bars R are spaced apart from the fourth ends E4 of the second group of reinforcing bars R. Further, a plurality of longitudinally extending rebars R are provided. At least some longitudinally extending reinforcing bars extend across the coupling beam, and, in some embodiments, from within the first wall 52 to within the second wall 54. Other longitudinally extending reinforcing bars may extend from at or near the edge of first wall 52 to at or near the edge of second wall 54. And, a plurality of horizontal transverse reinforcing elements, spaced vertically apart, and a plurality of vertical reinforcing elements, spaced horizontally apart, may be further provided. Such horizontal transverse reinforcing elements and vertical reinforcing elements may be selected from the group consisting of (a) stirrups, (b) closed stirrups, (c) hoops, and (d) cross ties. After the coupled shear wall is formed, a floor portion is formed adjacent to at least some of the shear walls. Then, the process is repeated as necessary to repeat the forming of a coupled shear wall and the forming of a floor portion for a selected number of levels N of the multi-story building 200. In one embodiment of the construction method, a self climbing forming system may be provided. In such case, the just described method further comprises raising the self climbing forming system to each successive level in the series of levels, upon completion of formation of the coupled shear wall at a then current level in the series of levels from 1 through N. Basically, the method involves forming the coupled shear wall system, by arranging reinforcing bar and then pouring concrete, to form a reinforced concrete coupled shear wall. In such a method, the forming of each floor may occur sequentially with respect to forming of the coupled shear wall at each level of the building. Alternately, some or all of the floors may be completed after the coupled core wall is completed. In yet another embodiment, at least some of the floors may be completed after the coupled core wall is only partially completed.

Figure 16:
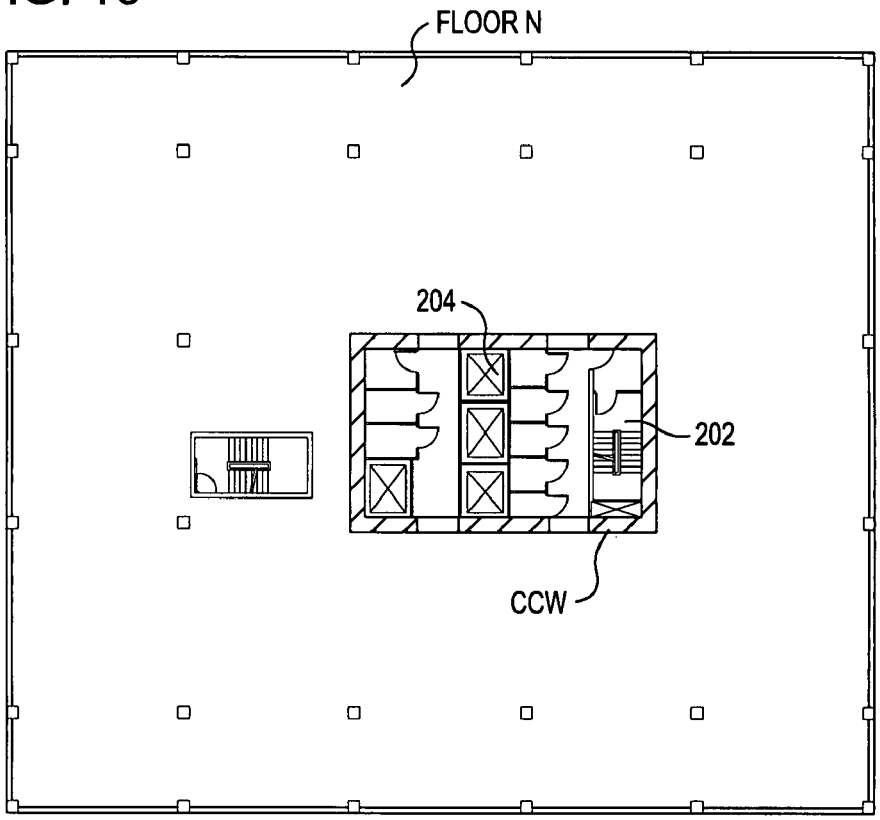
FIG. 16 is a plan view of a floor in the building just illustrated in FIG. 14, now showing the location of the coupled shear wall in relation to the remainder of a building floor.
Figure 17:
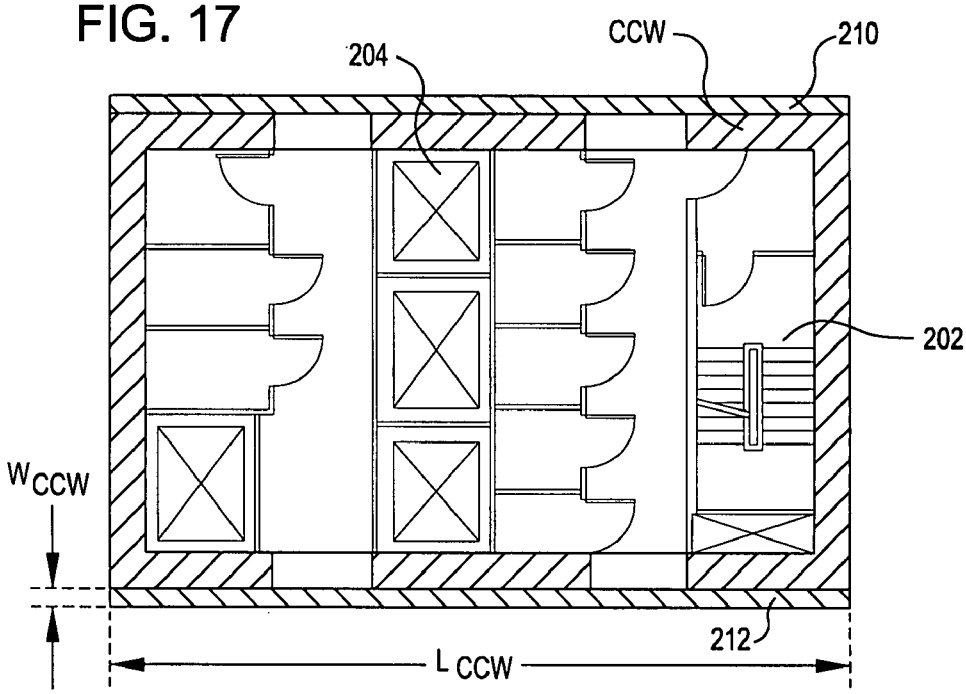
FIG. 17 is a plan view of a coupled shear wall system in a building such as that schematically illustrated in FIG. 14 above, now showing in cross-hatched fashion the floor space savings, and thus, additional floor space available, in a building that utilizes the partial-X coupling beam design disclosed herein.
Figure 18:
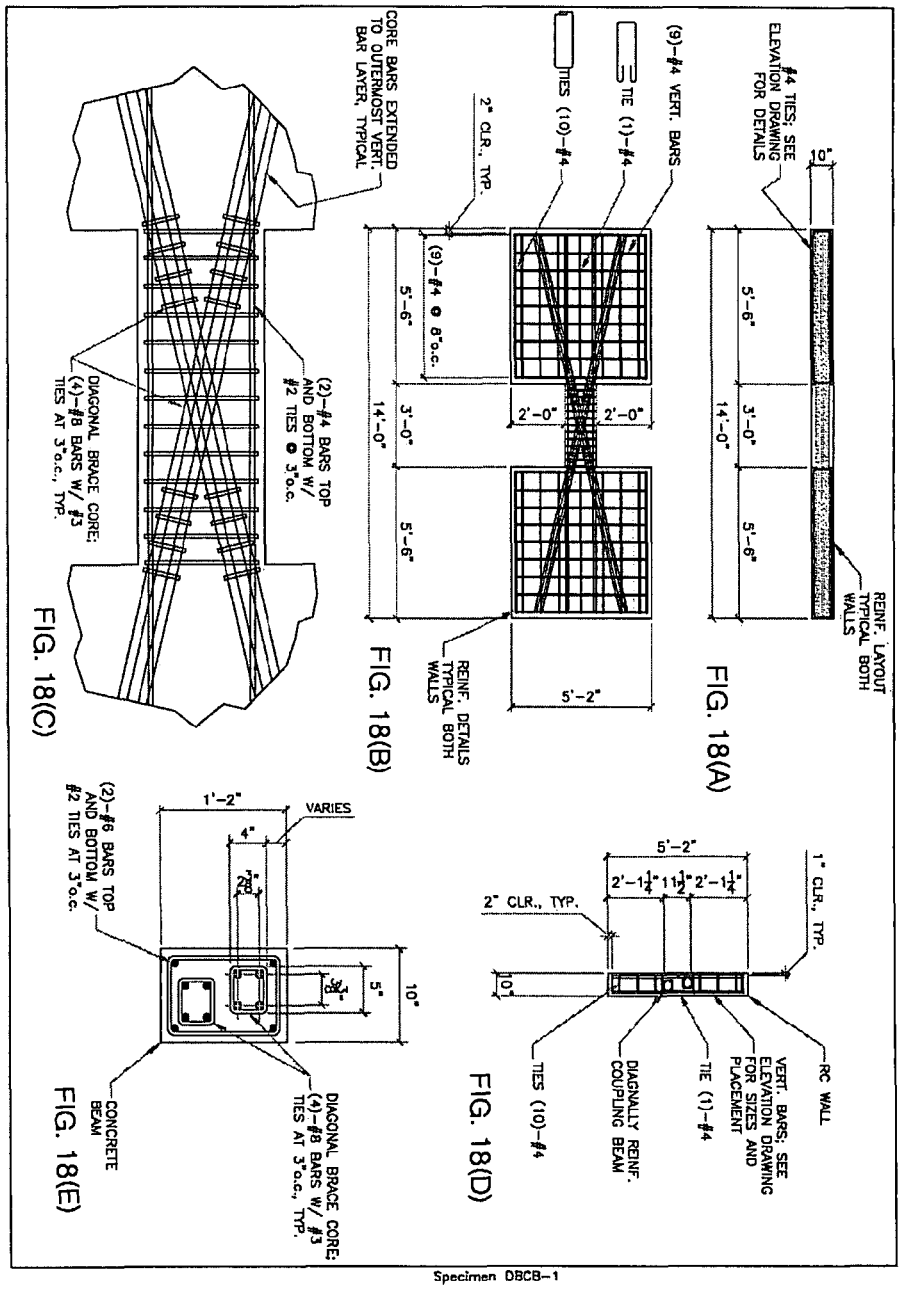
FIG. 18 includes FIGS. 18(A), 18(B), 18(C), 18(D), and 18(E), which collectively illustrate the prior art (and currently practiced) design for a diagonal reinforced coupling beam design, as constructed for performance testing.
Figure 19A:
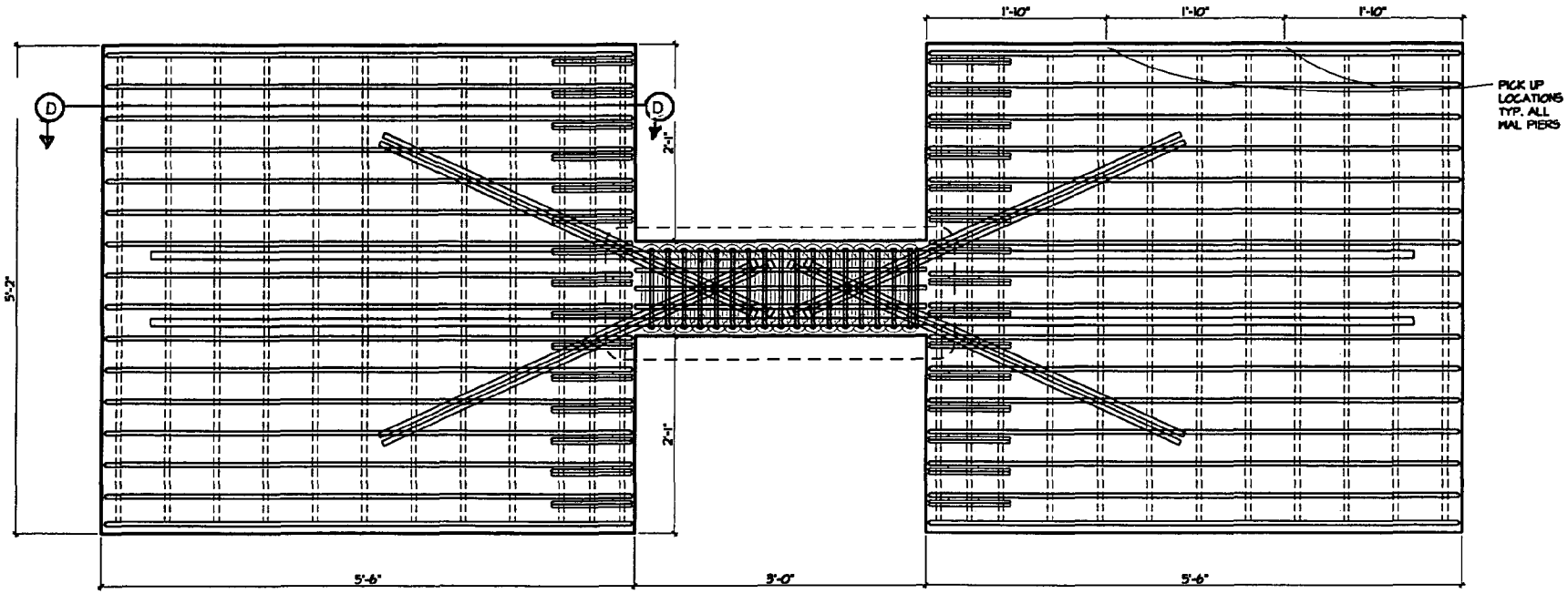
FIGS. 19(A), 19(B), 19(C), 19(D), and 19(E) collectively illustrate the novel coupling beam design disclosed and claimed herein, as constructed for performance testing.
Figure 19B:
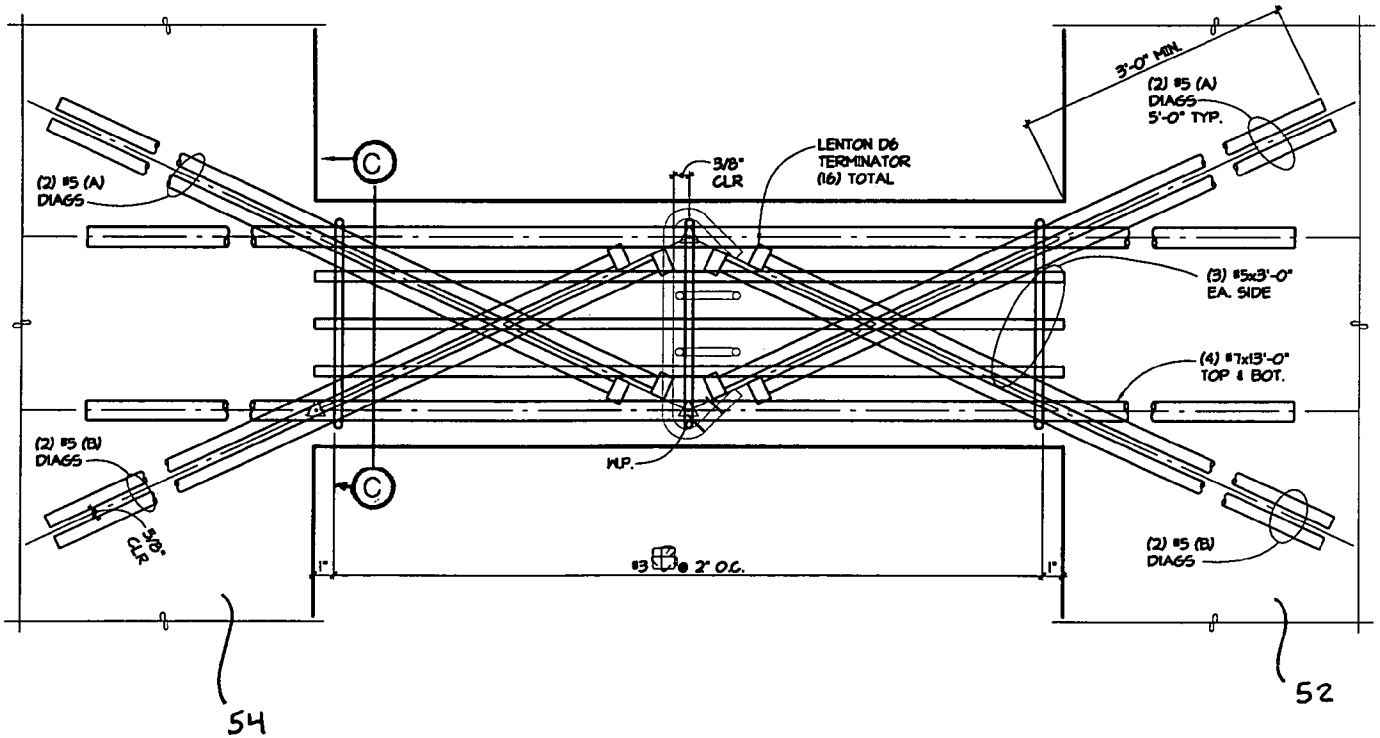
Figure 19C:
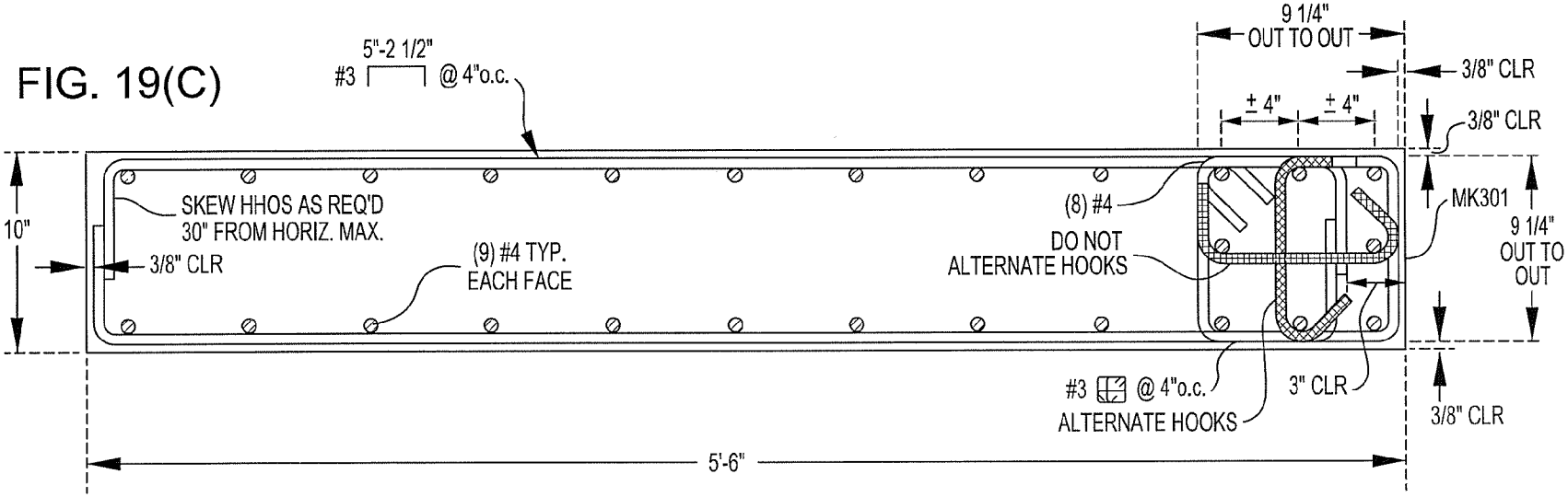
Figure 19D:
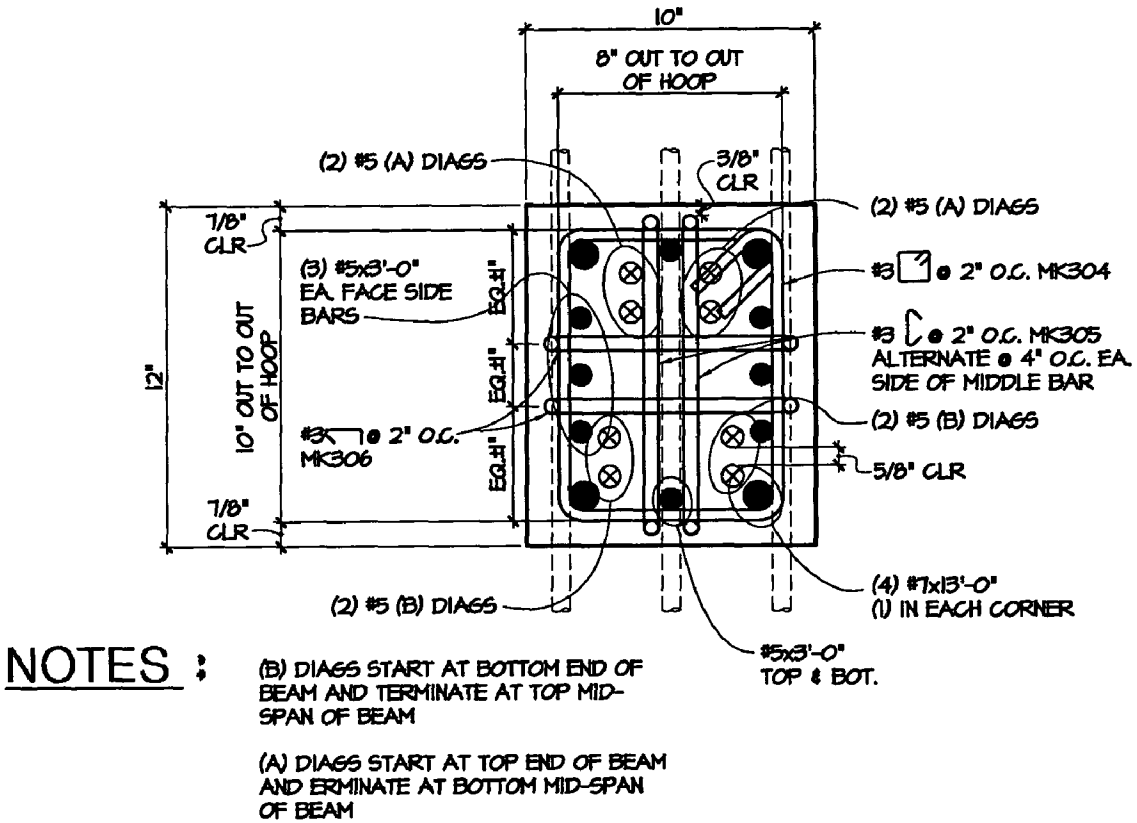
Figure 19E:
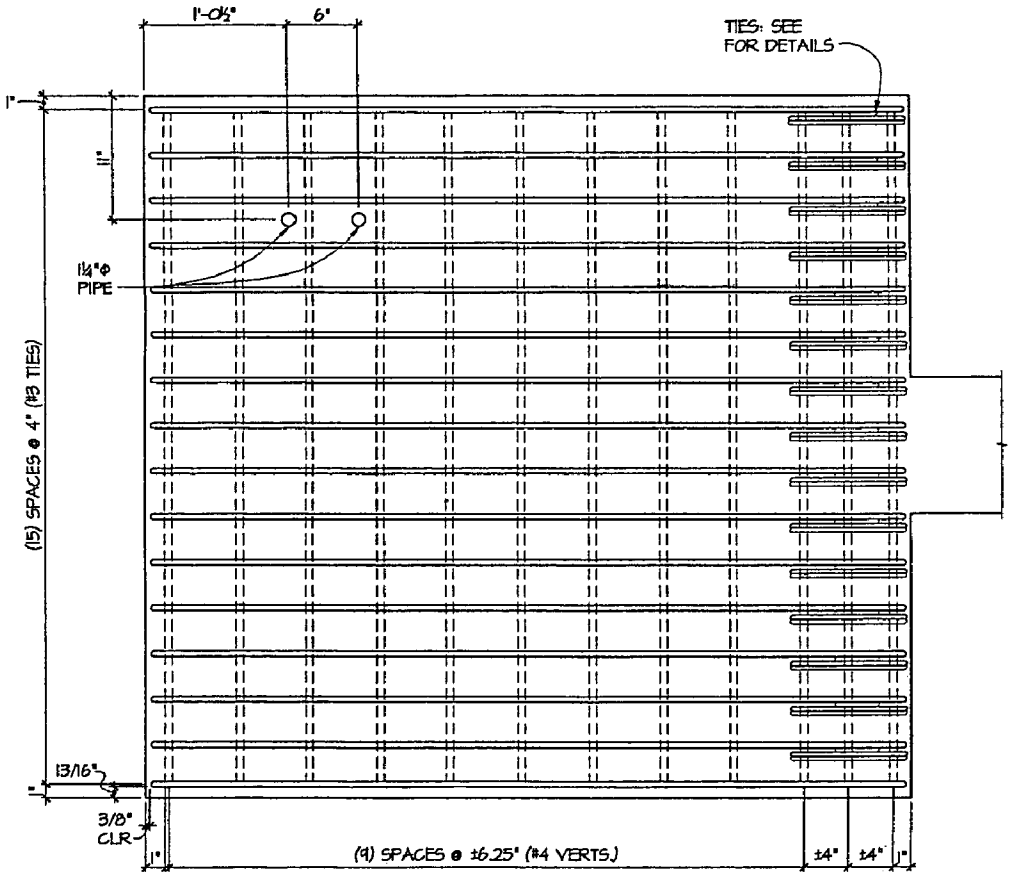

FIG. 16 shows a plan view of the layout of a typical floor N for multi-story building 200. The coupled core wall CCW or shear wall system is shown in the center, housing stairs 202, elevators 204, and utilities. FIG. 17 shows the coupled core wall CCW area in greater detail, and illustrates in cross hatched lines 210 and 212 the savings in floor area for each floor N of building 200 that may be realized by utilizing the coupled shear wall construction designs, and methods for their construction, as taught herein. Such savings may be considerable. For example, when comparing a hypothetical building constructed utilizing a prior art coupling beam design as set forth in FIG. 18 and in FIG. 20, with a multi-story building design as just discussed herein that utilizes the partial-X coupling beam design, key savings are as follows:

(a) reduction in rebar—cutting the required rebar quantity, per coupling beam by up to as much as fifty percent (50%), or thereabouts;

(b) reduction in placement labor—cutting the labor, per coupling beam, to perhaps as much as twenty five percent (25%) of that required to construct a prior art coupling beam;

(c) reduction in concrete costs—cutting the required amount of concrete, per coupling beam, by up to as much as ten percent (10%), or thereabouts;

(d) reduction in schedule—for a typical multi-story building, as much as a month of schedule might be saved;

(e) increasing net useable floor space.

As noted in FIG. 17, a length $L_{CCW}$ by $W_{CCW}$ is saved on each floor, when utilizing the coupled core wall designs taught herein. Thus, by saving square footage on each floor, overall parasitic floor space losses are reduced, and profits from net floor area, either rentable or saleable, are significantly increased.

Details of an exemplary embodiment for a coupled shear wall according to the teachings hereof are shown in FIGS. 19(A), 19(B), 19(C), 19(D), and 19(E). In particular, these figures add details of rebar designs that should enable those of ordinary skill in the art to quickly and efficiently layout the required rebar to properly construct a coupled shear wall system according to the design elements taught herein.

Figure 20:
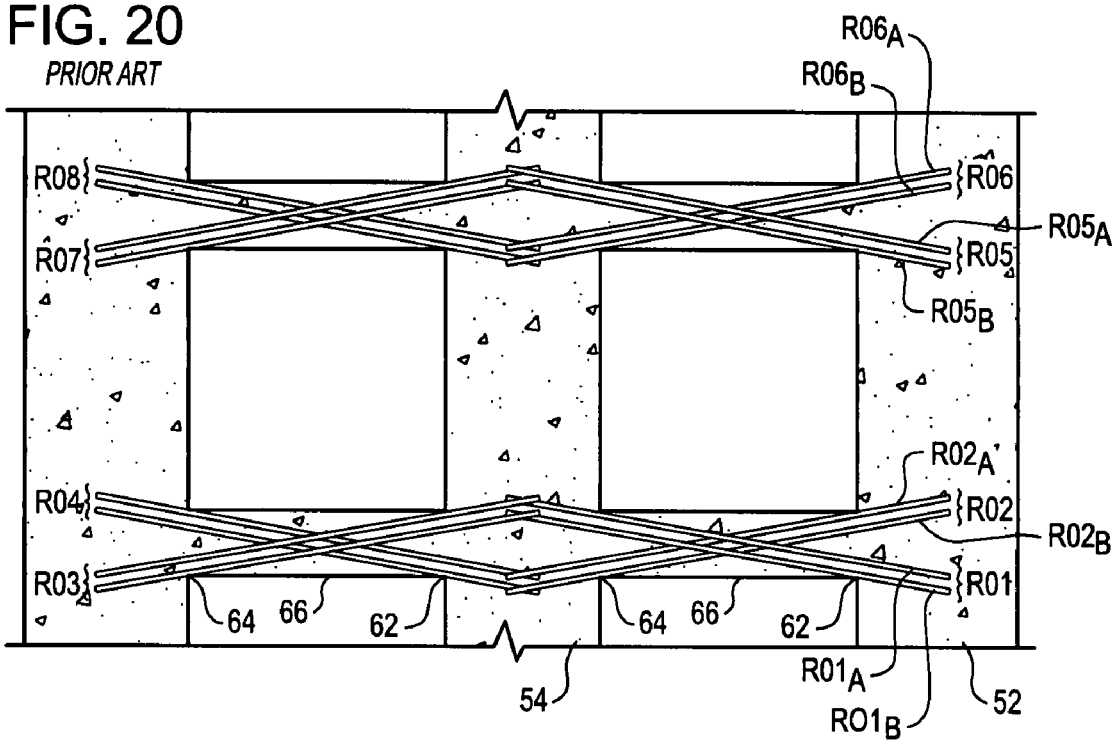
FIG. 20 PRIOR ART
FIG. 20 provides a see-through side elevation view of a prior art diagonally reinforced coupling beam configuration, showing the rebar configuration in a prior art coupled wall system.
Figure 21:
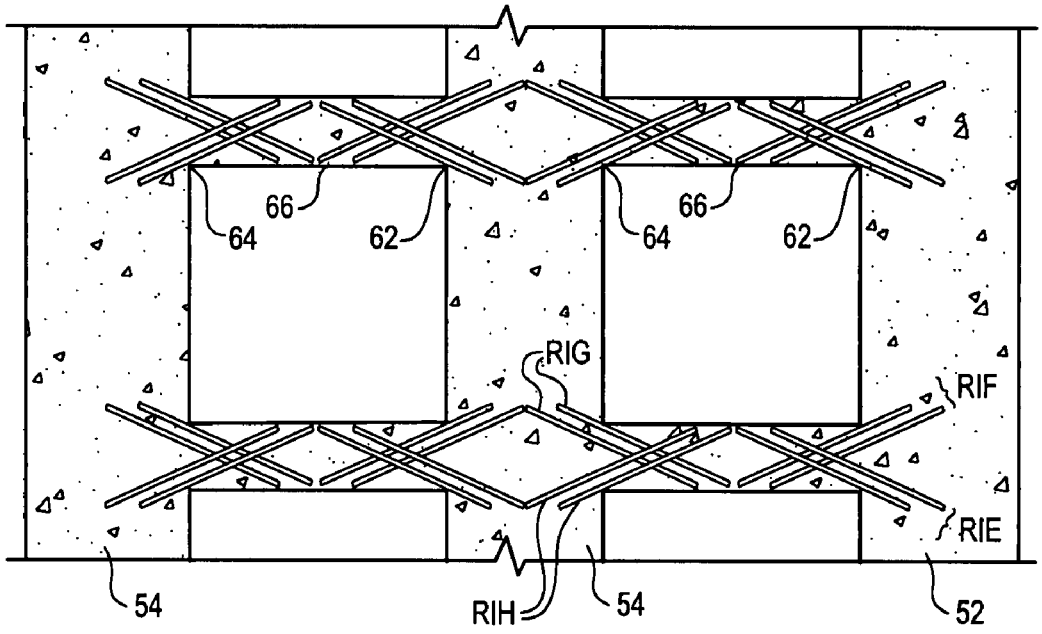
FIG. 21 provides a see-through side elevation view of an embodiment of the novel partial-X design coupled core wall system as described and claimed herein.
Figure 22:
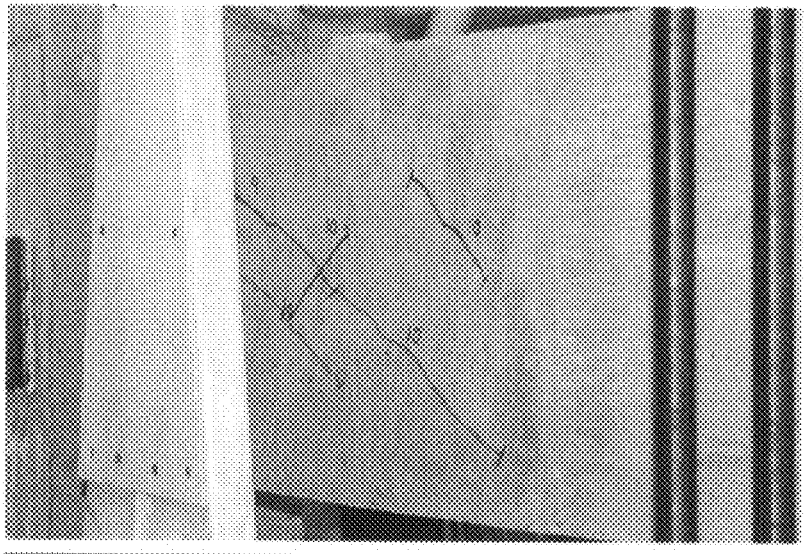
FIGS. 22 through 36 variously provide photographic views comparing the results of performance test results of a prior art coupling beam design and of the novel partial-X coupling beam design disclosed and claimed herein
Figure 23:
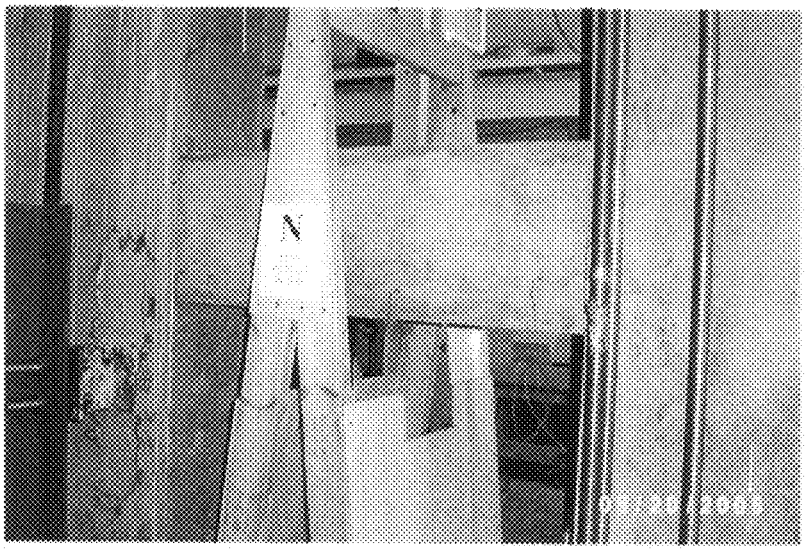
Figure 24:
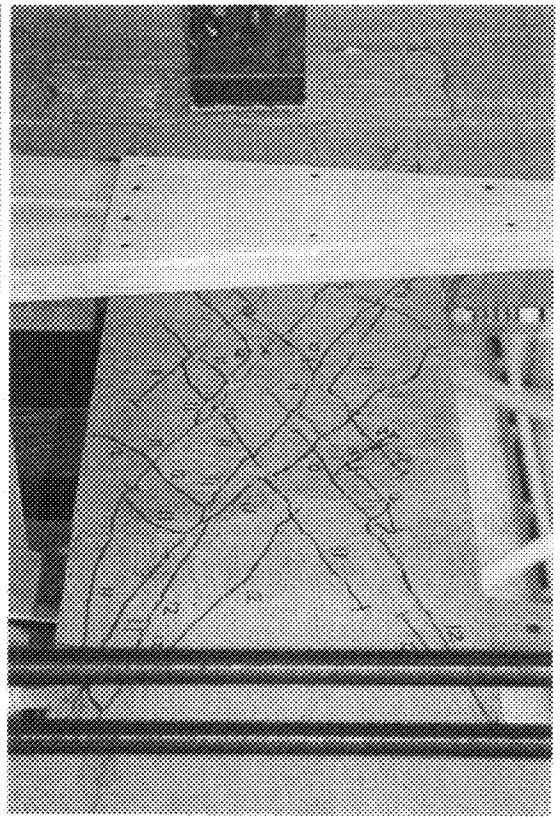
Figure 25:
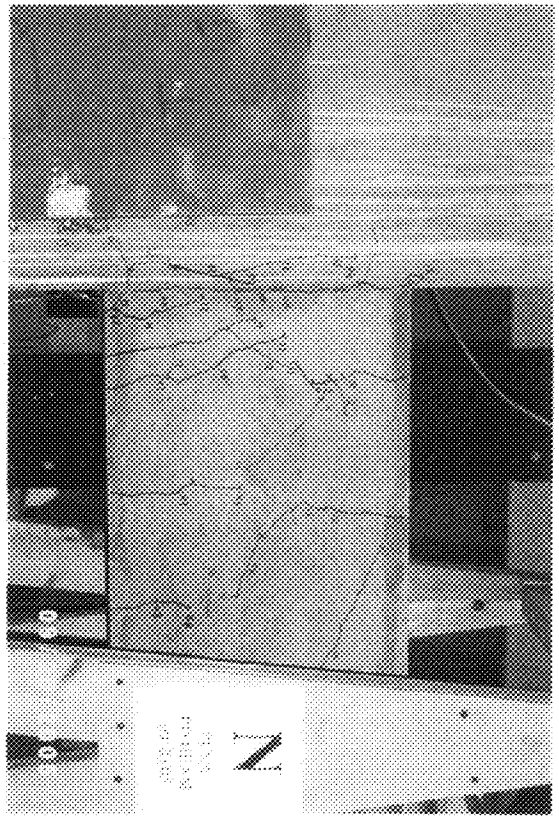
Figure 26:
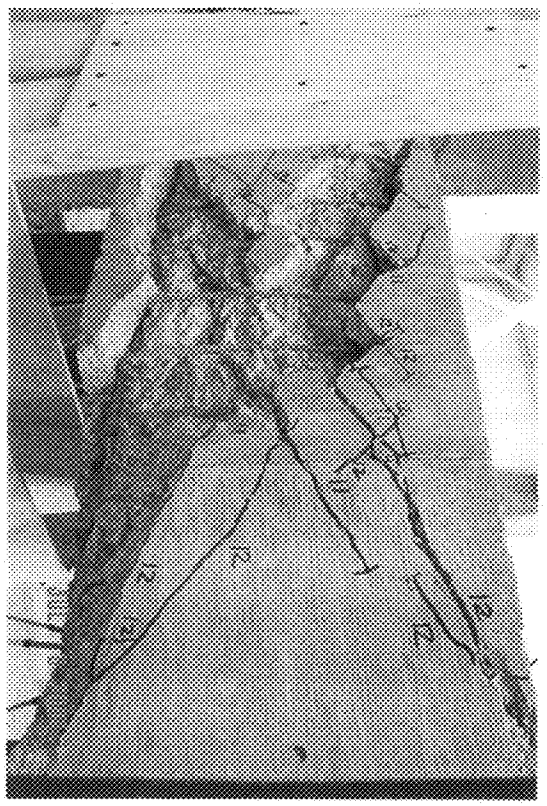
Figure 27:
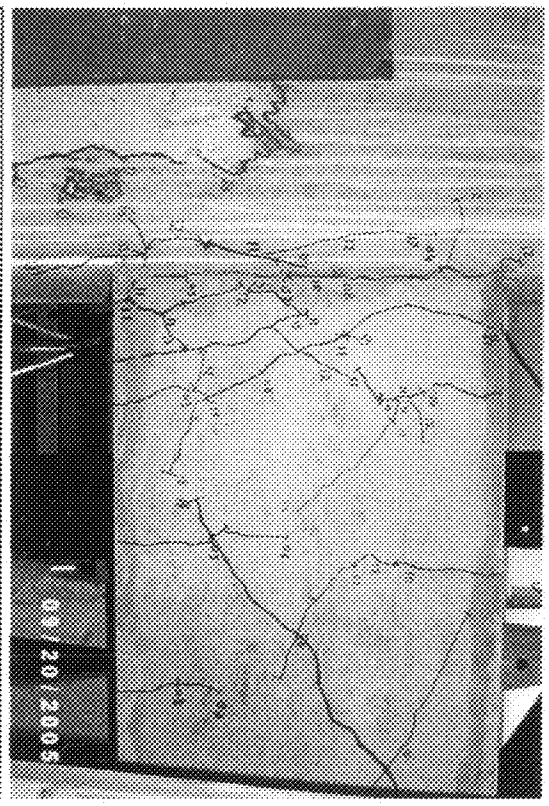
Figure 28:
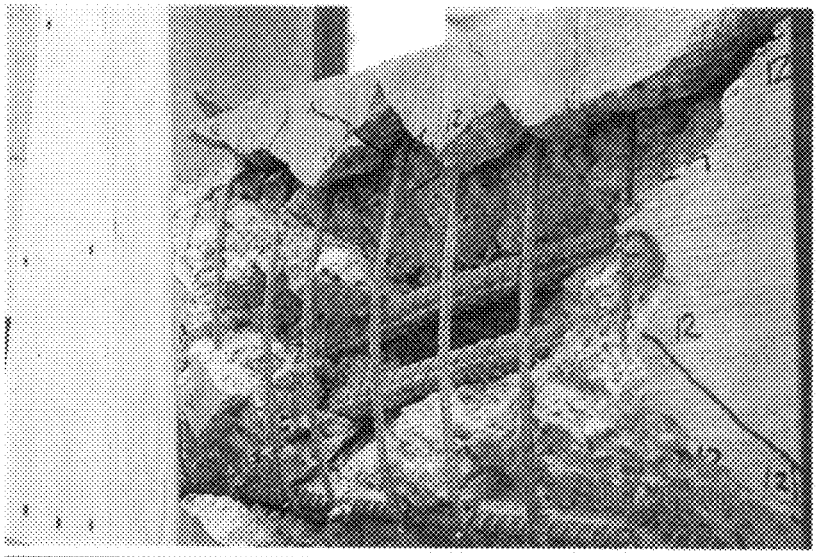
Figure 29:
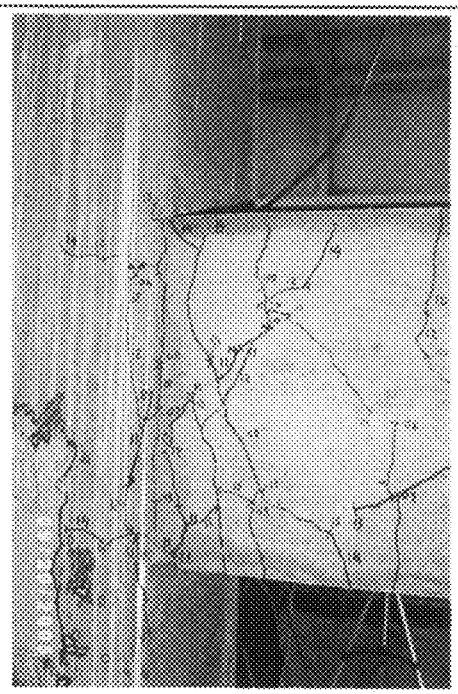
Figure 30:
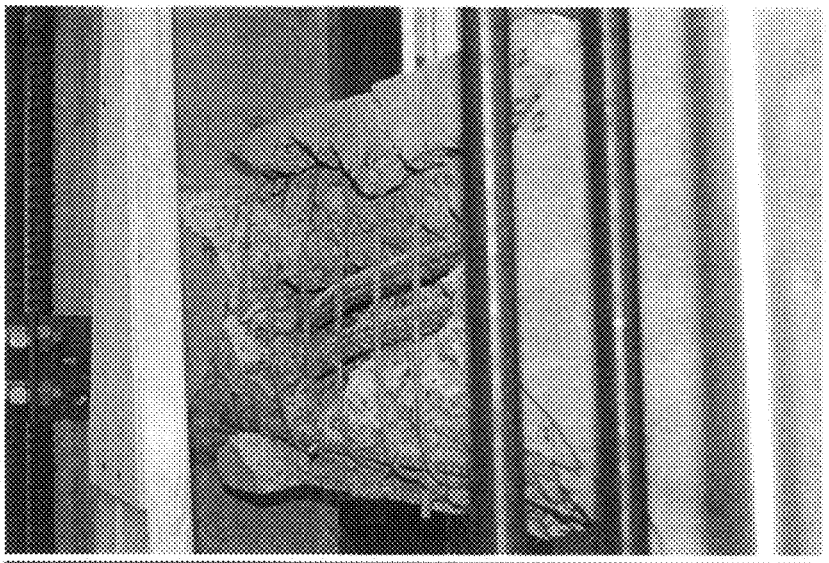
Figure 31:
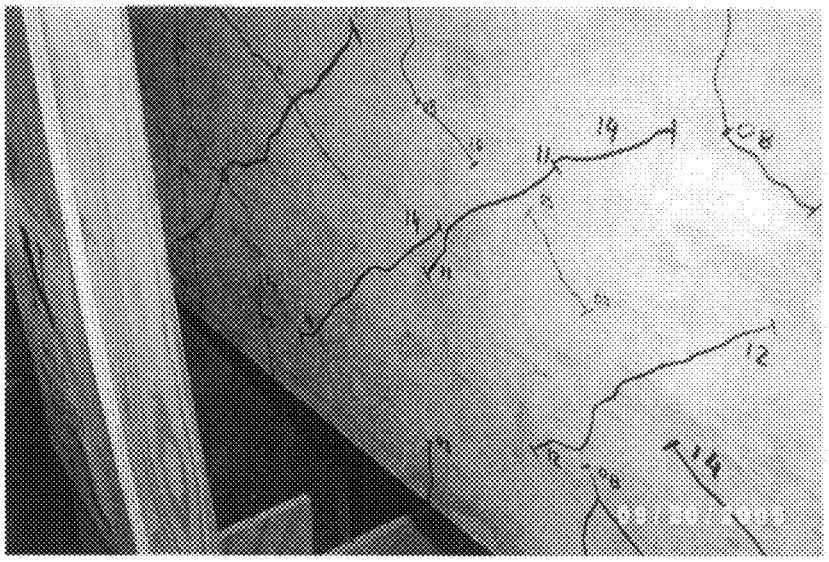
Figure 32:
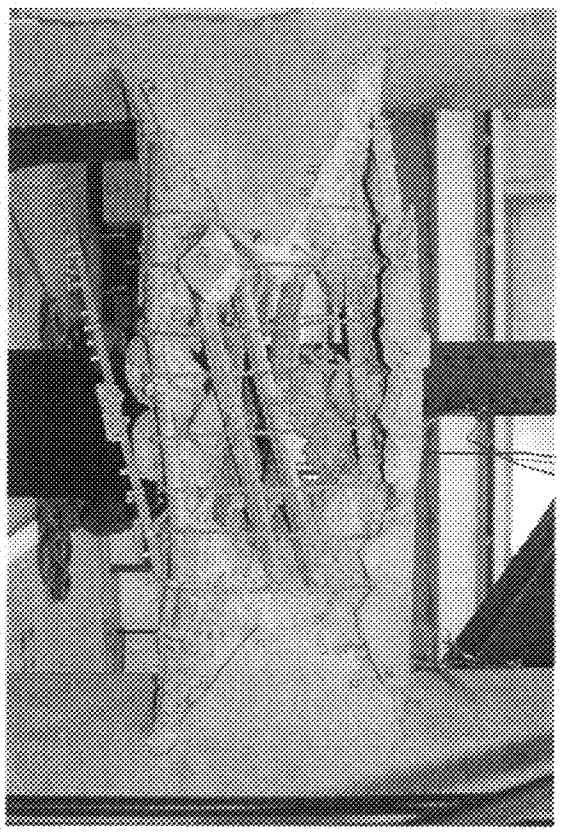
Figure 33:
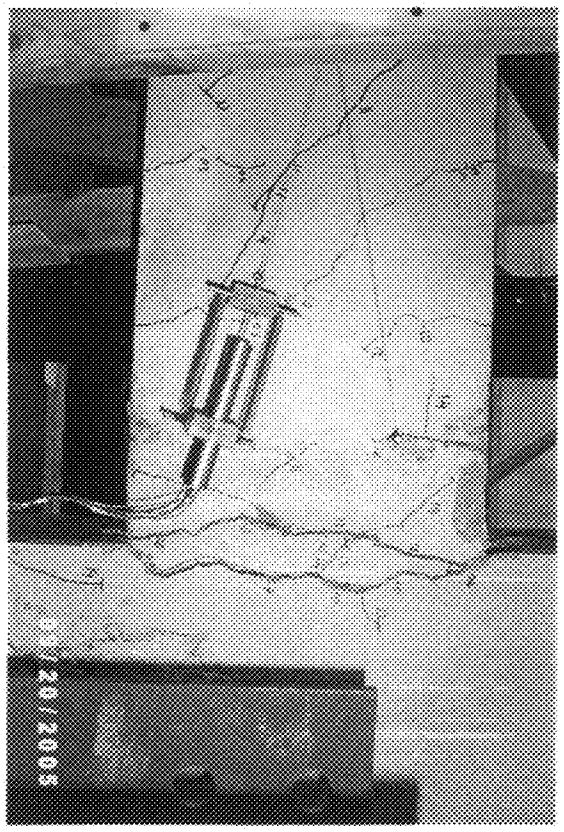
Figure 34:
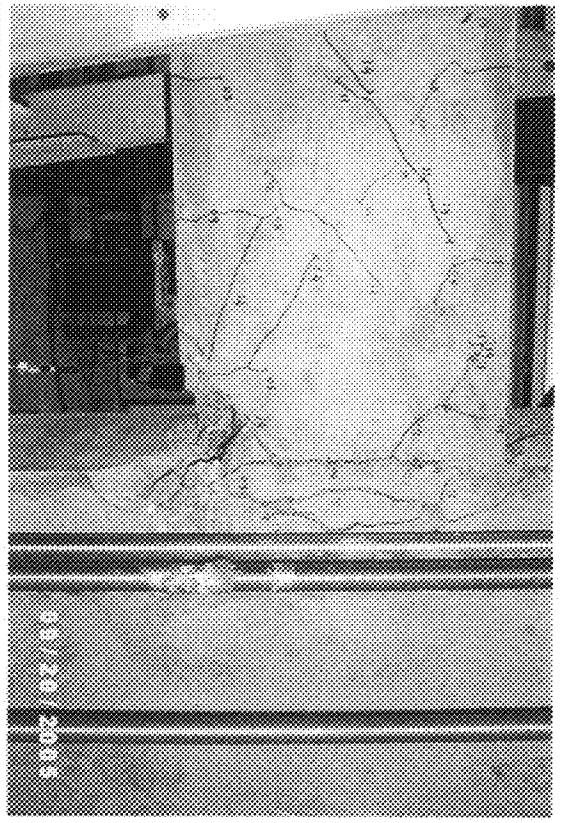
Figure 35:
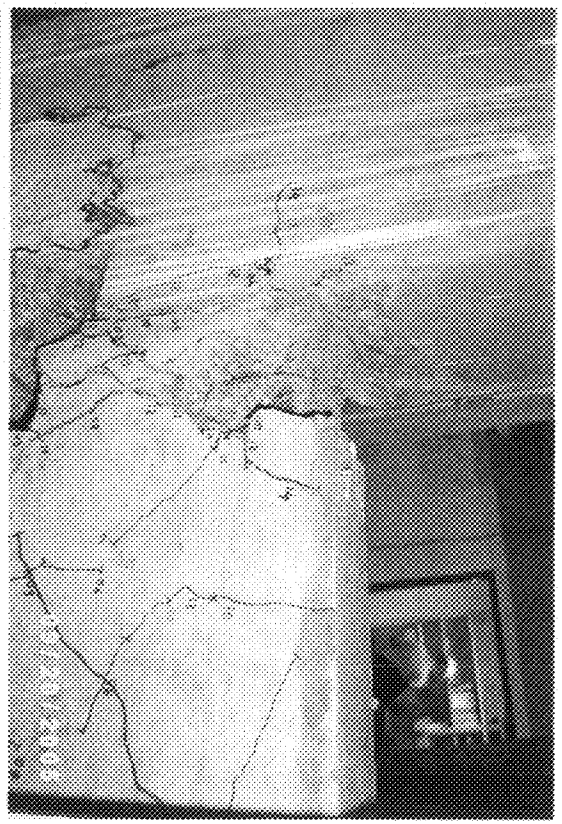
Figure 36:
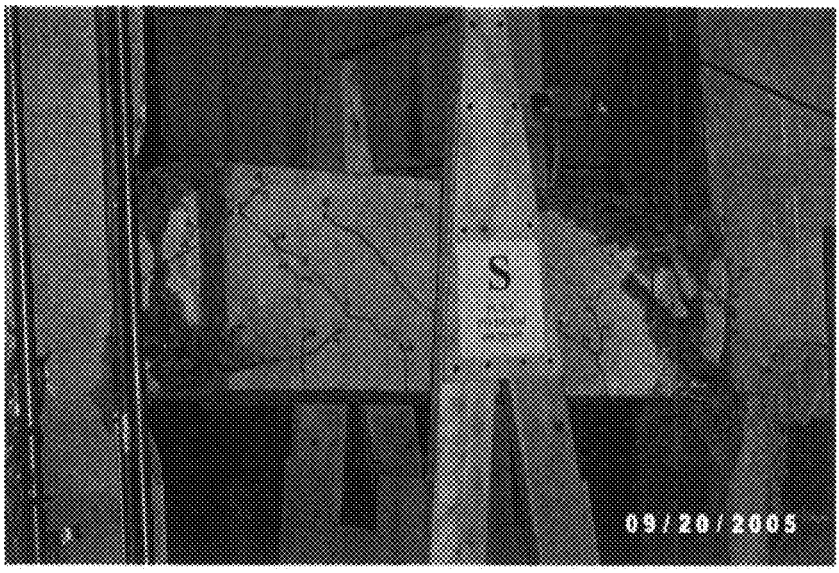
Figure 37:
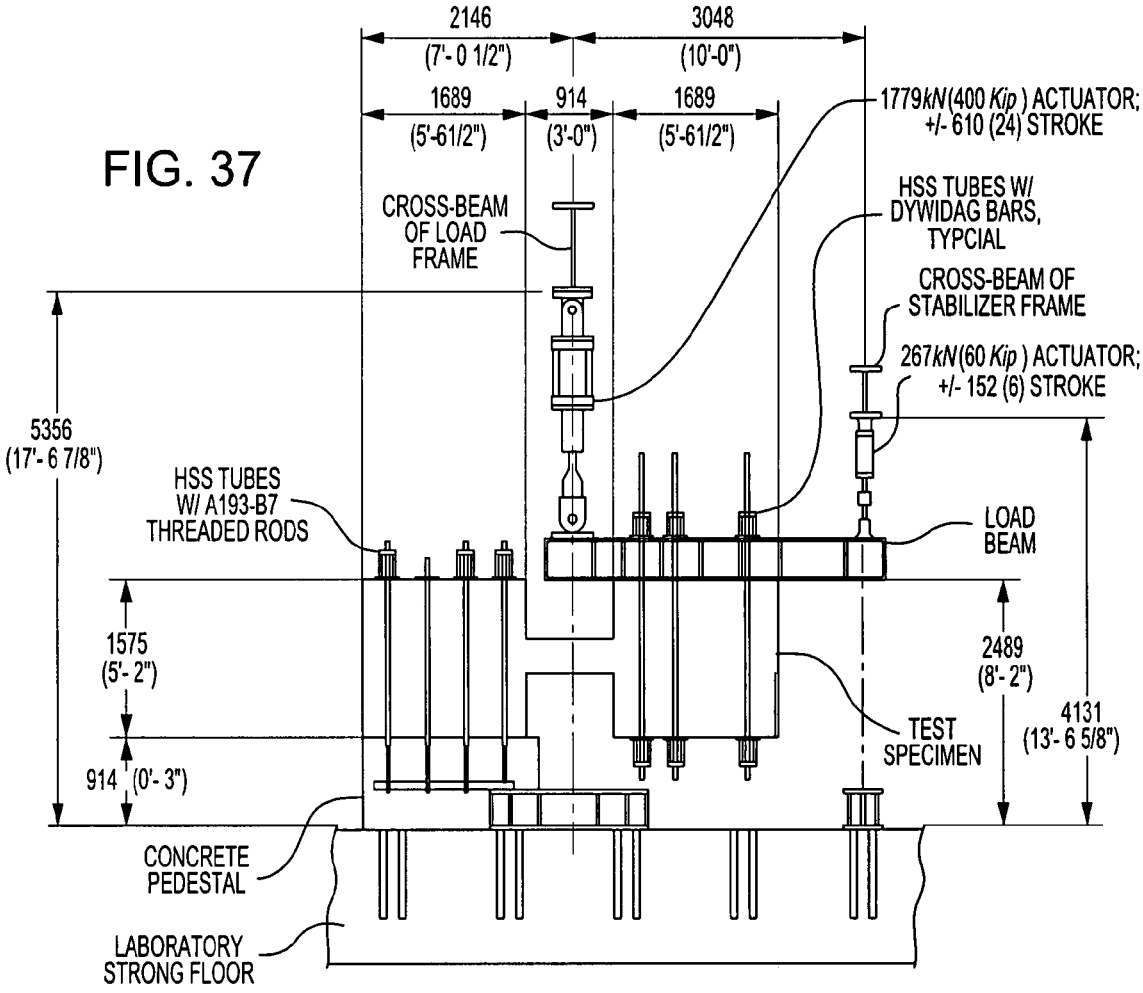
FIG. 37 provides a schematic of the test apparatus in which the novel partial-X coupling beam described herein was tested.

Attention is now drawn to FIG. 37, which depicts a test setup utilized for experimental testing of (a) a prior art diagonally reinforced concrete coupling beam design, generally of the type as illustrated in FIG. 20, and (b) a partial-X coupling beam design, generally of the type as that illustrated in FIG. 21. Basically, reinforced concrete pedestal was placed on a strong laboratory floor. Positioning rods were provided to clamp the test coupling beam specimens. A load actuator was utilized to apply shear to the test coupling beam specimens.

As noted in FIG. 20, one a prior art diagonally reinforced concrete coupling beam with a central portion 66 between first end 62 and second end 64 uses first rebar element R01 (having, for example, a plurality of rebars R01$_A$, R01$_B$, etc.) and second rebar element R02 (having, for example, a plurality of rebars R02$_A$, R02$_B$, etc.). Another prior art diagonally reinforced coupling beam with central portion 66 uses a third rebar element R03 and fourth rebar element R04. Another prior art diagonally reinforced concrete coupling beam with a central portion 66 between first end 62 and second end 64 uses fifth rebar element R05 (having, for example, a plurality of rebars R05$_A$, R05$_B$, etc.) and sixth rebar element R06 (having, for example, a plurality of rebars R06$_A$, R06$_B$, etc.). Yet another prior art diagonally reinforced coupling beam with central portion 66 uses a seventh rebar element R07 and eighth rebar element R08.

Turning to FIG. 21, an improved coupling beam design as taught herein is depicted. Here, a diagonally reinforced concrete coupling beam with a central portion 66 between first end 62 and second end 64 uses first rebar element RIE and second rebar element RIF, as well as a third rebar element RIG and a fourth rebar element RIH, in order to provide the design taught herein.

Figure 39:
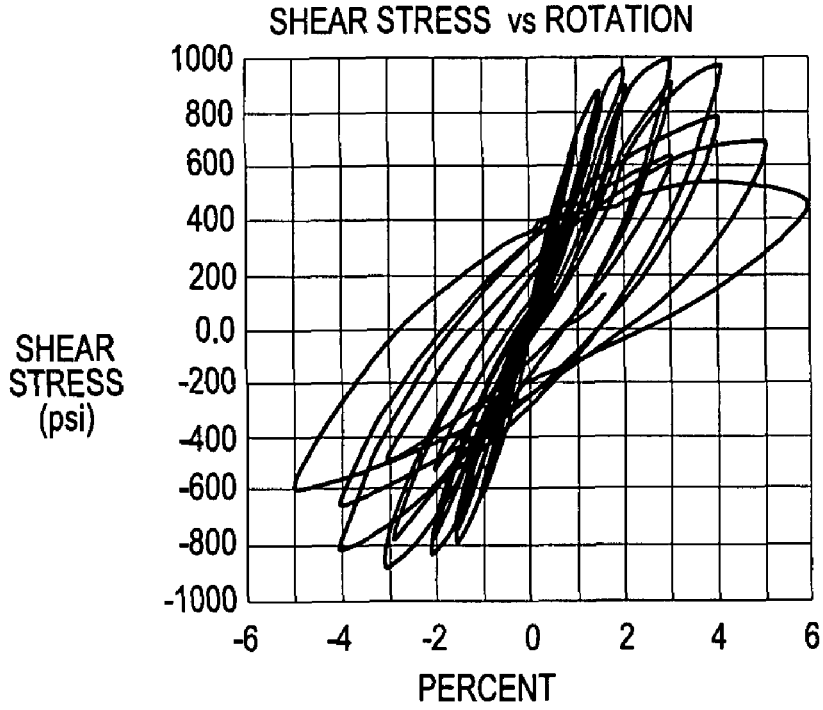
FIG. 39 illustrates the hysteretic behavior of a prior art coupling beam design, showing poor structural behavior.
Figure 7:
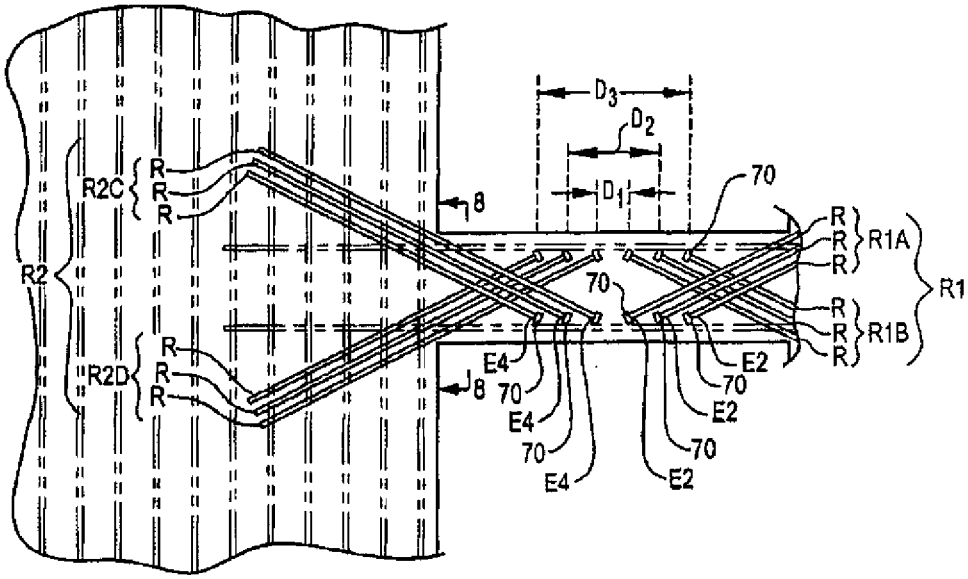
Figure 18D:
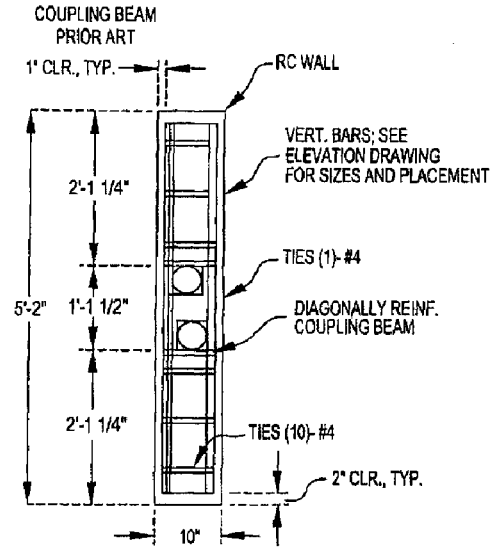
FIG. 18(D) provides a vertical cross-sectional view of the coupled shear wall system design tested, and with respect to which results are photographically illustrated in FIGS. 22, 24, 26, 28, 30, and 32.
Figure 18A:
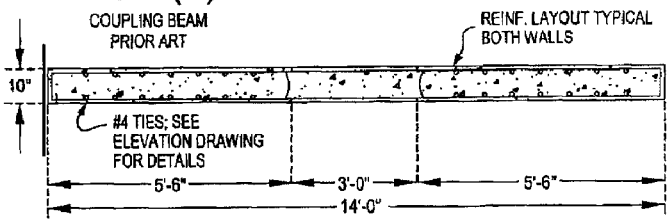
FIG. 18(A) shows in plan view the coupled core wall system design tested, and with respect to which results are photographically illustrated in FIGS. 22, 24, 26, 28, 30, and 32.
Figure 18E:
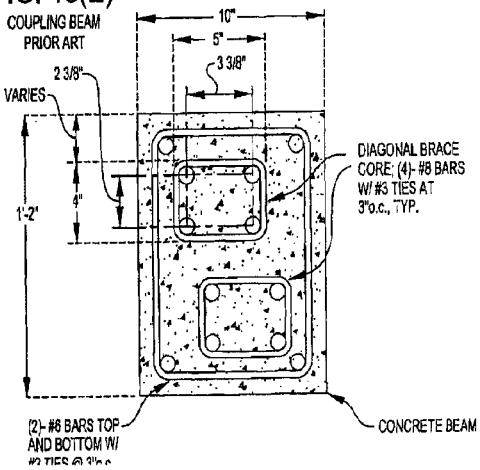
FIG. 18(E) provides a transverse cross-sectional view taken through the coupling beam shown in FIG. 18(C), now showing in detail the transverse reinforcing steel hoops, as well as the two groups of intersecting diagonal reinforcing bars.
Figure 18B:
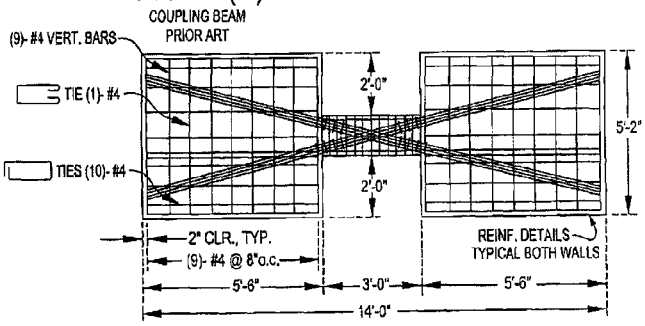
FIG. 18(B) provides an elevation view of the coupled shear wall system design tested, and with respect to which results are photographically illustrated in FIGS. 22, 24, 26, 28, 30, and 32.
Figure 18C:
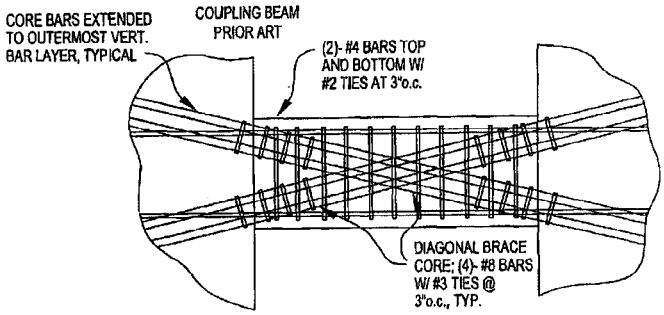
FIG. 18(C) provides an partial enlarged cut-away elevation view of the coupled shear wall system design tested, and with respect to which results are photographically illustrated in FIGS. 22, 24, 26, 28, 30, and 32, showing the prior art diagonal reinforced coupling beam design.
Figure 19A:
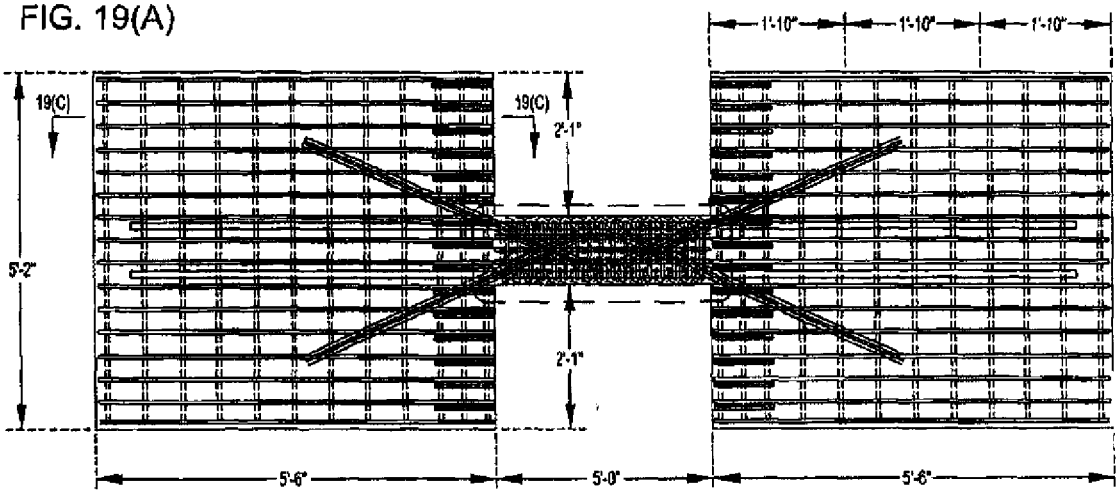
Figure 19B:
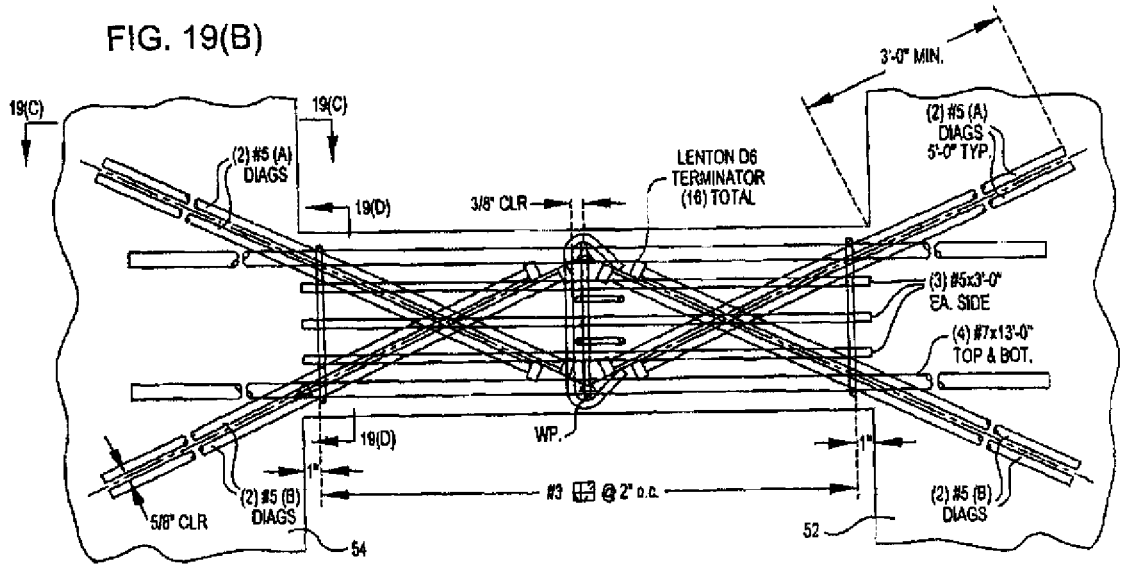
Figure 19C:
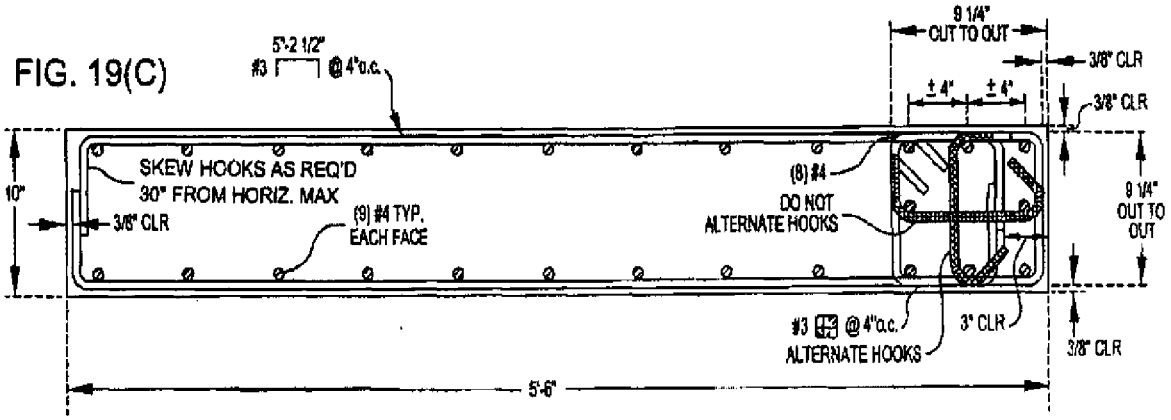
Figure 19D:
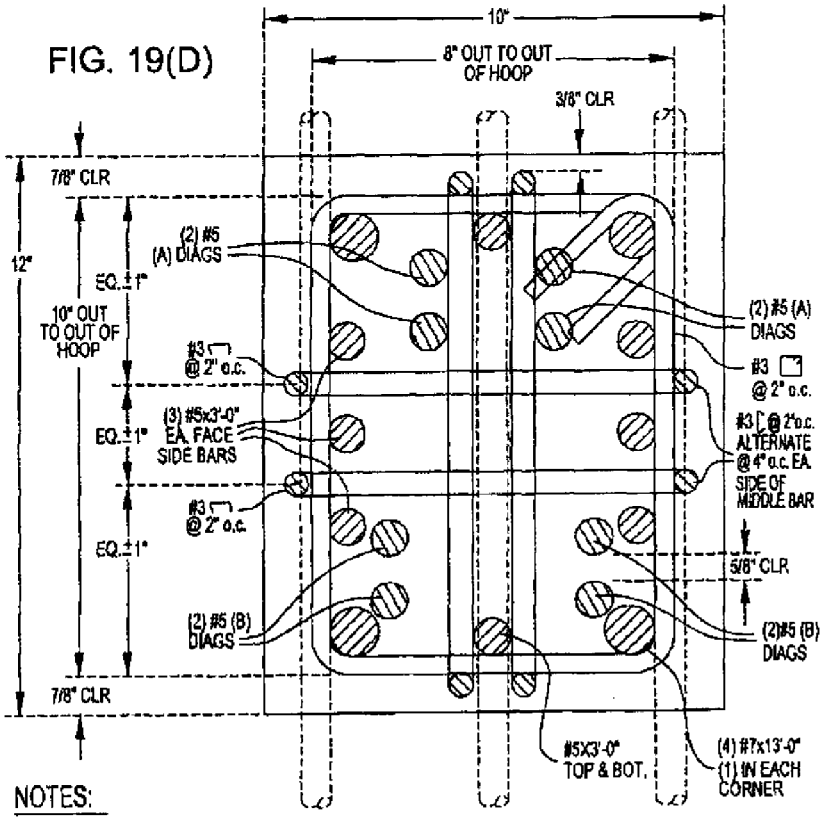
Figure 19E:
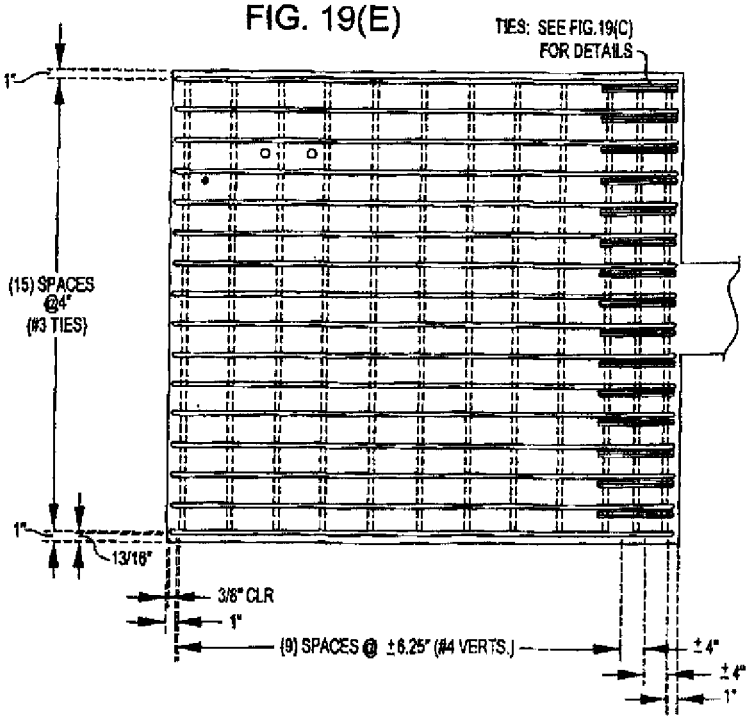

Turning now to the various photographs shown in FIGS. 22 through 36, a prior art diagonally reinforced concrete beam was tested at up to six percent (6%) rotation, with substantial failure observed at four percent (4%) rotation. The novel partial-X diagonally reinforced concrete beam was tested at up to nine percent (9%) rotation. With respect to the prior art diagonally reinforced concrete beam, the beam was considered to have reached the failure limit at four percent (4%) rotation. That test was stopped upon reaching the point of six percent (6%) rotation. With the prior art diagonally reinforced concrete beam, the hysteretic response of the test specimen was reasonably stable at up to about three percent (3%) rotation, as seen in FIG. 39, but strength degradation is experienced beyond that point, especially as the confined area began to degrade, as seen in the various photographs. At the final peak force of loading, the stirrup, longitudinal bar, and diagonal bar strains were well beyond the yield point.

Figure 38:
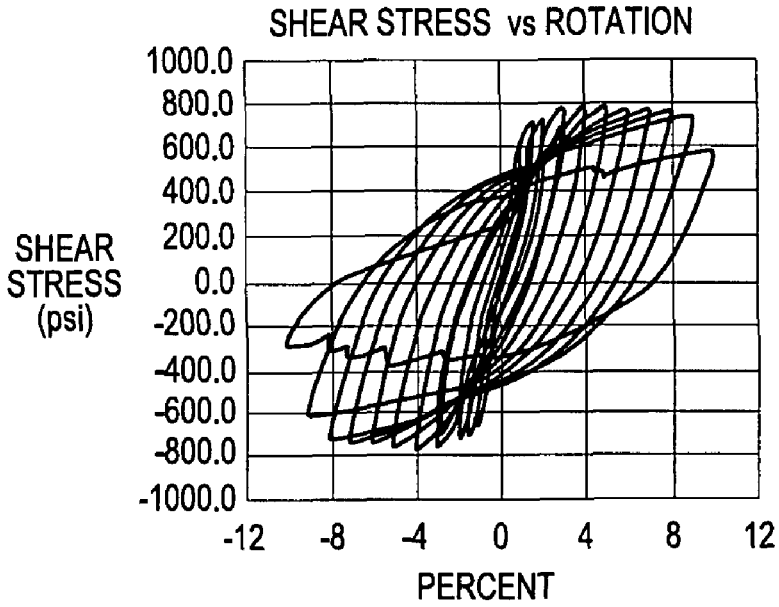
FIG. 38 illustrates the hysteretic behavior of the novel partial-X coupling beam design described and claimed herein, showing the superior structural behavior, i.e., good energy absorbing characteristics in response to lateral forces.

By way of explanation, the hysteretic loops shown in FIGS. 38 and 39 are graphs of force versus deformation characteristics, and as applied to coupled shear wall systems, the graph is determined by applying deformation forces that are typically well beyond the yield point, and which are applied cyclically, in order to determine the anticipated lateral force response for a given component or shear wall system. In hysteretic loop graphs, the area within the plot is associated with the energy dissipated by the component or system.

Testing of the partial-X design coupling beam, constructed as described herein, showed that such a coupling beam design provides performance levels that meet or exceed the anticipated rotational demands up to about 9% rotation, while performing in a ductile manner. Further, based on the test results as photographically depicted in FIGS. 33 through 36, such a beam design appears repairable by simple and economical epoxy injection, after rotations of about 6% or greater. This is because the beam is intact, and thus has significant reserve capacity against collapse, and likely could be repaired without requirement that the multi-story building in which it is employed need be shut down. On the other hand, coupling beams constructed with prior art diagonally reinforced coupling beam designs are destroyed at rotations exceeding about three percent (3%), thus likely contributing to significant damage in other structural members, and would likely render a building unsafe for occupation. These comparison results are believed highly reliable, since the respective coupling beam test specimens were tested at the same laboratory, utilizing the same test frame.

In the foregoing description, for purposes of explanation, numerous details have been set forth in order to provide a thorough understanding of the disclosed exemplary embodiments for a coupled shear wall system, and for buildings utilizing such coupled shear wall systems. However, certain of the described details may not be required in order to provide useful embodiments, or to practice a selected or other disclosed embodiments. Further, the description includes, for descriptive purposes, various relative terms such as adjacent, proximity, adjoining, near, on, onto, on top, underneath, underlying, downward, lateral, and the like. Such usage should not be construed as limiting. That is, terms that are relative only to a point of reference are not meant to be interpreted as limitations, but are instead included in the foregoing description to facilitate understanding of the various aspects of the disclosed embodiments of the present invention. Further, various steps or operations in a method described herein may have been described as multiple discrete operations, in turn, in a manner that is most helpful in understanding the present invention. However, the order of description should not be construed as to imply that such operations are necessarily order dependent. In particular, certain operations may not need to be performed in the order of presentation. In different embodiments of the invention, one or more operations may be eliminated while other operations may be added. Also, the reader will note that the phrase "in one embodiment" has been used repeatedly. This phrase generally does not refer to the same embodiment; however, it may. Finally, the terms "comprising", "having" and "including" should be considered synonymous, unless the context dictates otherwise.

Importantly, the aspects and embodiments described and claimed herein may be modified from those shown without materially departing from the novel teachings and advantages provided by this invention, and may be embodied in other specific forms without departing from the spirit or essential characteristics thereof. Therefore, the embodiments presented herein are to be considered in all respects as illustrative and not restrictive or limiting. As such, this disclosure is intended to cover the structures described herein and not only structural equivalents thereof, but also equivalent structures. Numerous modifications and variations are possible in light of the above teachings. Therefore, the protection afforded to this invention should be limited only by the claims set forth herein, and the legal equivalents thereof.

The invention claimed is:

1. A coupled shear wall, comprising:

a first wall, a second wall, and a coupling beam that couples said first wall with said second wall, said first wall, said second wall, and said coupling beam each comprising reinforcing bar and concrete, said reinforcing bar comprising a first group of reinforcing bar, said first group of reinforcing bar comprising a first set comprising one or more reinforcing bars, and a second set comprising one or more reinforcing bars, said first set and said second set of reinforcing bars each comprising two or more rebar, said first set inclined upwardly and said second set inclined downwardly, each of said first group of reinforcing bar having first and second ends, at least some of said first ends located within said first wall and at least some of said second ends located within said coupling beam;

a second group of reinforcing bar, said second group of reinforcing bar comprising a third set comprising one or more of reinforcing bars, and a fourth set comprising one or more of reinforcing bars, said third set and said fourth set of bars each comprising two or more rebars, said third set inclined upwardly and said fourth set inclined downwardly, said second group of reinforcing bar having third and fourth ends, at least some of said third ends located within said second wall and at least some of said fourth ends located within said coupling beam.

2. The coupled shear wall as set forth in claim 1, wherein each of said second ends of said first group of reinforcing bar are spaced apart from said fourth ends of said second group of reinforcing bar.

3. The coupled shear wall as set forth in claim 1, wherein said coupling beam comprises a first end, a second end, and a central portion, wherein said coupling beam extends for a length $L_{beam}$ between said first end and said second end, and wherein said second ends of said first group of reinforcing bar and said fourth ends of said second group of reinforcing bar are located within said central portion of said coupling beam.

4. The coupled shear wall as set forth in claim 1, or in claim 3, wherein said first set of said reinforcing bar is inclined upwardly at an angle alpha ($\alpha$).

5. The coupled shear wall as set forth in claim 1, or in claim 3, wherein said second set of reinforcing bar is inclined downwardly at an angle beta ($\beta$).

6. The coupled shear wall as set forth in claim 1, or in claim 3, wherein said third set of reinforcing bar is inclined upwardly at an angle delta ($\Delta$).

7. The coupled shear wall as set forth in claim 1, or in claim 3, wherein said fourth set of reinforcing bar is inclined downwardly at an angle theta ($\theta$).

8. The coupled shear wall as set forth in claim 1, or in claim 3, wherein said first set of said reinforcing bar is inclined upwardly at an angle alpha ($\alpha$), and wherein said second set of reinforcing bar is inclined downwardly at an angle beta ($\beta$), and wherein said angle alpha and said angle beta are equal and opposite.

9. The coupled shear wall as set forth in claim 1, or in claim 3, wherein said third set of said reinforcing bar is inclined upwardly at an angle delta ($\Delta$), and wherein said fourth set of reinforcing bar is inclined downwardly at an angle theta ($\theta$), and wherein said angle delta and said angle theta are equal and opposite.

10. The coupled shear wall as set forth in claim 8, wherein one or more of said inclination angles alpha, and beta, are larger by a factor of about two, or more, compared to a maximum possible inclination angle zeta (Z) achievable using a continuous rebar extended fully across the length of said coupling beam and developed into the adjacent shear walls.

11. The coupled shear wall as set forth in claim 1, wherein one or more of said second ends of said first group of reinforcing bar further comprises a mechanical end anchor.

12. The coupled shear wall as set forth in claim 1 wherein each of said second ends of said first group of reinforcing bar further comprises a mechanical end anchor.

13. The coupled shear wall as set forth in claim 11 or in claim 12, wherein said mechanical end anchor comprises a generally cylindrical body.

14. The coupled shear wall as set forth in claim 1, wherein one or more of said fourth ends of said second group of reinforcing bar further comprises a mechanical end anchor.

15. The coupled shear wall as set forth in claim 1 wherein each of said fourth ends of said second group of reinforcing bar further comprises a mechanical end anchor.

16. The coupled shear wall as set forth in claim 14 or in claim 15, wherein said mechanical end anchor comprises a generally cylindrical device.

17. The coupled shear wall as set forth in claim 1, wherein one or more of said second ends of said first group of reinforcing bar comprise a standard hook configuration.

18. The coupled shear wall as set forth in claim 1, wherein one or more of said fourth ends of said second group of reinforcing bar comprise a standard hook configuration.

19. The coupled shear wall as set forth in claim 1, wherein one or more of said second ends of said first group of reinforcing bar comprise a straight linear rebar configuration.

20. The coupled shear wall as set forth in claim 1, wherein one or more of said fourth ends of said second group of reinforcing bar comprise a straight linear rebar configuration.

21. The coupled shear wall as set forth in claim 1, wherein said first set and said second set of reinforcing bars are transversely spaced apart.

22. The coupled shear wall as set forth in claim 1, wherein the first set and said second set of reinforcing bars are vertically spaced apart.

23. The coupled shear wall as set forth in claim 1, wherein said first set and said second set of reinforcing bars are transversely and vertically spaced apart.

24. The coupled shear wall as set forth in claim 1, wherein said first set and said second set of reinforcing bars are bundled together.

25. The coupled shear wall as set forth in claim 1, wherein said third set and said fourth set of reinforcing bars are transversely spaced apart.

26. The coupled shear wall as set forth in claim 1, wherein the third set and said fourth set of reinforcing bars are vertically spaced apart.

27. The coupled shear wall as set forth in claim 1, wherein said third set and said fourth set of reinforcing bars are transversely and vertically spaced apart.

28. The coupled shear wall as set forth in claim 1, wherein said third set and said fourth set of reinforcing bars are bundled together.

29. The coupled shear wall as set forth in claim 1, wherein said first set and said second set of reinforcing bars are located between said third set and said fourth set of reinforcing bars.

30. The coupled shear wall as set forth in claim 1, further comprising one or more of longitudinally extending reinforcing bar, said longitudinally extending reinforcing bar extending across said coupling beam, from within said first wall to within said second wall.

31. The coupled shear wall as set forth in claim 1, wherein said coupling beam further comprises confinement reinforcing components.

32. The coupled shear wall as set forth in claim 31, further comprising one or more transverse reinforcing components within said coupling beam.

33. The coupled shear wall as set forth in claim 31, further comprising one or more vertical reinforcement components spaced apart across said coupling beam.

34. The coupled shear wall as set forth in claim 32, or in claim 33, wherein one or more of said reinforcement components comprises a horizontal reinforcement component.

35. The coupled shear wall as set forth in claim 32, or in claim 33, further comprising one or more cross ties, said cross ties confiningly extending between two or more of said longitudinally extending reinforcing bars.

36. The coupled shear wall as set forth in claim 32, or in claim 33, further comprising cross-ties extending between two or more vertical reinforcing bars.

37. The coupled shear wall as set forth in claim 1, further comprising one or more of longitudinally extending reinforcing bar, at least one of said longitudinally extending reinforcing rebar extending across at least a portion of said coupling beam, but not into either said first wall or said second wall.

38. The coupled shear wall as set forth in claim 31, wherein at least some of said confinement reinforcing components are selected from the group consisting of (a) stirrups, (b) closed stirrups, (c) hoops, and (d) cross ties.

39. The coupled shear wall as set forth in claim 31, wherein said confinement reinforcing components comprise metal.

40. The coupled shear wall as set forth in claim 31, wherein said confinement reinforcing components comprise a composite material.

41. A coupled shear wall, comprising;

a first wall;

a second wall;

a coupling beam that couples said first wall with said second wall;

said first wall, said second wall, and said coupling beam each comprising reinforcing bar and concrete, said reinforcing bar comprising a first group of intersecting diagonally placed reinforcing bar extending across a first portion of the length of the coupling beam, said first group of intersecting diagonally placed reinforcing bars comprising a first set of reinforcing bars and a second set of reinforcing bars, said first group of reinforcing bars having first ends located in said first wall and second ends located in said coupling beam;

a second group of intersecting diagonally placed reinforcing bar extending across a second length of the coupling beam, said second group of intersecting diagonally placed reinforcing bars comprising a third set of reinforcing bars and a fourth set of reinforcing bars, said second group of reinforcing bars having third ends located in said second wall and fourth ends located in said coupling beam;

wherein said first group of intersecting diagonally placed reinforcing bars are anchored within said first wall, and wherein said second group of intersecting diagonally placed reinforcing bars are anchored within said second wall;

wherein said first group and said second group of intersecting diagonally placed reinforcing bars are each anchored within said coupling beam; and wherein each of said second ends of said first group of reinforcing bar are spaced apart from said fourth ends of said second group of reinforcing bar.

42. The coupled shear wall as set forth in claim 41, further comprising one or more of longitudinally extending reinforcing bar, said longitudinally extending reinforcing bar extending across at least a portion of said coupling beam;

one or more of confinement reinforcing elements, said confinement reinforcing elements comprising vertical reinforcing elements selected from the group consisting of (a) stirrups, (b) closed stirrups, (c) hoops, and (d) cross ties; and one or more of horizontal reinforcing elements, said horizontal reinforcing elements selected from the group consisting of (a) stirrups, (b) closed stirrups, (c) hoops, and (d) cross ties.

43. The coupled shear wall as set forth in claim 42, wherein said first set of said reinforcing bar is inclined upwardly at an angle alpha ($\alpha$), and wherein said second set of reinforcing bar is inclined downwardly at an angle beta ($\beta$), and wherein said angle alpha and said angle beta are equal and opposite.

44. The coupled shear wall as set forth in claim 42, wherein said third set of said reinforcing bar is inclined upwardly at an angle delta ($\Delta$), and wherein said fourth set of reinforcing bar is inclined downwardly at an angle theta ($\theta$), and wherein said angle delta and said angle theta are equal and opposite.

45. The coupled shear wall as set forth in claim 9, wherein one or more of said inclination angles delta ($\Delta$) and theta ($\theta$), are larger by a factor of about two, or more, compared to a maximum possible inclination angle zeta (Z) achievable using a continuous rebar extended fully across the length of said coupling beam and developed into the adjacent shear walls.

* * * * *

UNITED STATES PATENT AND TRADEMARK OFFICE

CERTIFICATE OF CORRECTION

PATENT NO. : 7,934,347 B2
APPLICATION NO. : 11/881517
DATED : May 3, 2011
INVENTOR(S) : Paul Brienen It is certified that error appears in the above-identified patent and that said Letters Patent is hereby corrected as shown below:

IN THE DRAWINGS:

Remove existing Figs 7, 18, 19(A), 19(B), 19(C), 19(D) and 19(E) and replace with Figs 7, 18(A), 18(B), 18(C), 18(D), 18(E), 19(A), 19(B), 19(C), 19(D) and 19(E) attached.

Signed and Sealed this
Fourteenth Day of April, 2015

Michelle K. Lee

Michelle K. Lee
*Director of the United States Patent and Trademark Office*

NOTES:

(B) DIAGS START AT BOTTOM END OF BEAM AND TERMINATE AT TOP MID-SPAN OF BEAM (A) DIAGS START AT TOP END OF BEAM AND TERMINATE AT BOTTOM MID-SPAN OF BEAM